US011636863B2

(12) United States Patent
Shlomot et al.

(10) Patent No.: US 11,636,863 B2
(45) **Date of Patent: *Apr. 25, 2023**

(54) STEREO SIGNAL ENCODING METHOD AND ENCODING APPARATUS

(71) Applicant: Huawei Technologies Co., Ltd., Shenzhen (CN)

(72) Inventors: Eyal Shlomot, Long Beach, CA (US); Jonathan Alastair Gibbs, Cumbria (GB); Haiting Li, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/552,682

(22) Filed: Dec. 16, 2021

(65) Prior Publication Data

US 2022/0108709 A1 Apr. 7, 2022

Related U.S. Application Data

(63) Continuation of application No. 16/797,484, filed on Feb. 21, 2020, now Pat. No. 11,244,691, which is a (Continued)

(30) Foreign Application Priority Data

Aug. 23, 2017 (CN) ..... 201710731482.1

(51) Int. Cl.
*G10L 19/008* (2013.01)
*G10L 19/04* (2013.01)

(52) U.S. Cl.
CPC ..... *G10L 19/008* (2013.01); *G10L 19/04* (2013.01)

(58) Field of Classification Search
CPC ..... G10L 19/008; G10L 19/04
See application file for complete search history.

(56) References Cited

U.S. PATENT DOCUMENTS 6,393,392 B1 * 5/2002 Minde ..... G10L 19/16 704/219
9,424,852 B2 * 8/2016 Briand ..... H04S 3/008
(Continued)

FOREIGN PATENT DOCUMENTS

CN 102089809 A 6/2011
CN 102307323 A 1/2012
(Continued)

OTHER PUBLICATIONS

Fatus, B., et al., "Master Thesis: Parametric Coding for Spatial Audio," Jul.-Dec. 2015, 70 pages.
(Continued)

*Primary Examiner* — Feng-Tzer Tzeng
(74) *Attorney, Agent, or Firm* — Conley Rose, P.C.

(57) ABSTRACT

A stereo signal encoding method includes determining a window length of an attenuation window based on an inter-channel time difference; determining a modified linear prediction analysis window based on the window length of the attenuation window, where values of at least some points from a point (L−sub_window_len) to a point (L−1) in the modified linear prediction analysis window are less than values of corresponding points from a point (L−sub_window_len) to a point (L−1) in an initial linear prediction analysis window, and the window length of the modified linear prediction analysis window is equal to a window length of the initial linear prediction analysis window; and performing linear prediction analysis on a to-be-processed sound channel signal based on the modified linear prediction analysis window.

22 Claims, 12 Drawing Sheets

Related U.S. Application Data continuation of application No. PCT/CN2018/101524, filed on Aug. 21, 2018.

(56) References Cited

U.S. PATENT DOCUMENTS

| | | | | |
|---|---|---|---|---|
| 10,937,435 | B2 * | 3/2021 | Fueg | G10L 21/04 |
| 2009/0198501 | A1 | 8/2009 | Jeong et al. | |
| 2009/0313028 | A1 * | 12/2009 | Tammi | G10L 19/265 704/500 |
| 2015/0049872 | A1 * | 2/2015 | Virette | G10L 19/008 381/23 |
| 2017/0061972 | A1 * | 3/2017 | Briand | G10L 19/20 |
| 2017/0116997 | A1 * | 4/2017 | Gibbs | G10L 19/12 |
| 2017/0236521 | A1 | 8/2017 | Chebiyyam et al. | |
| 2018/0233154 | A1 | 8/2018 | Vaillancourt et al. | |
| 2020/0194015 | A1 | 6/2020 | Shlomot et al. | |

FOREIGN PATENT DOCUMENTS

| | | | |
|---|---|---|---|
| CN | 103403800 | A | 11/2013 |
| CN | 104205211 | A | 12/2014 |
| EP | 0864146 | B1 | 10/2004 |
| JP | 2013088522 | A | 5/2013 |
| KR | 20090083070 | A | 8/2009 |
| KR | 20180056661 | A | 5/2018 |
| KR | 102380642 | B1 | 3/2022 |
| WO | 1997021211 | A1 | 6/1997 |
| WO | 2009107054 | A1 | 9/2009 |
| WO | 2012105885 | A1 | 8/2012 |

OTHER PUBLICATIONS

Bertrand Fatus et al., "Master Thesis Parametric Coding for Spatial Audio," Jul.-Dec. 2015, 70 pages.

* cited by examiner

STEREO SIGNAL ENCODING METHOD AND ENCODING APPARATUS

CROSS-REFERENCE TO RELATED APPLICATIONS

This application is a continuation of U.S. patent application Ser. No. 16/797,484 filed on Feb. 21, 2020, which is a continuation of International Patent Application No. PCT/CN2018/101524 filed on Aug. 21, 2018, which claims priority to Chinese Patent Application No. 201710731482.1 filed on Aug. 23, 2017. All of the aforementioned patent applications are hereby incorporated by reference in their entireties.

TECHNICAL FIELD

This application relates to the field of audio signal encoding/decoding technologies, and more specifically, to a stereo signal encoding method and an encoding apparatus.

BACKGROUND

A general process of encoding a stereo signal using a time-domain stereo encoding technology includes the following steps estimating an inter-channel time difference of a stereo signal, performing delay alignment processing on the stereo signal based on the inter-channel time difference, performing, based on a parameter for time-domain downmixing processing, time-domain downmixing processing on a signal obtained after delay alignment processing, to obtain a primary sound channel signal and a secondary sound channel signal, and encoding the inter-channel time difference, the parameter for time-domain downmixing processing, the primary sound channel signal, and the secondary sound channel signal, to obtain an encoded bitstream.

Before delay alignment processing is performed on the stereo signal based on the inter-channel time difference, first, a sound channel with a greater delay may be selected from a left sound channel and a right sound channel of the stereo signal based on the inter-channel time difference to serve as a target sound channel, and the other sound channel is selected as a reference sound channel for performing delay alignment processing on the target sound channel, then, delay alignment processing is performed on a target sound channel signal. In this way, there is no inter-channel time difference between a target sound channel signal obtained after delay alignment processing and a reference sound channel signal. In addition, delay alignment processing further includes manually reconstructing a forward signal on the target sound channel.

However, some signals (including a transition segment signal and the forward signal) on the target sound channel are manually determined, and these manually determined signals and real signals differ greatly. Consequently, a real linear prediction coefficient and a linear prediction coefficient may differ to some extent, where the linear prediction coefficient is obtained when linear prediction analysis is performed, using a mono coding algorithm, on the primary sound channel signal and the secondary sound channel signal that are determined based on a stereo signal obtained after delay alignment processing, and encoding quality is affected.

SUMMARY

This application provides a stereo signal encoding method and an encoding apparatus, to improve accuracy of linear prediction in an encoding process.

It should be understood that a stereo signal in this application may be a raw stereo signal, a stereo signal including two signals included in a multichannel signal, or a stereo signal including two signals jointly generated by a plurality of signals included in a multichannel signal.

In addition, the stereo signal encoding method in this application may be a stereo signal encoding method used in a multichannel encoding method.

According to a first aspect, a stereo signal encoding method is provided. The method includes determining a window length of an attenuation window in a current frame based on an inter-channel time difference in the current frame, determining a modified linear prediction analysis window based on the window length of the attenuation window in the current frame, where values of at least some points from a point (L−sub_window_len) to a point (L−1) in the modified linear prediction analysis window are less than values of corresponding points from a point (L−sub_window_len) to a point (L−1) in an initial linear prediction analysis window, sub_window_len represents the window length of the attenuation window in the current frame, and L represents a window length of the modified linear prediction analysis window, and the window length of the modified linear prediction analysis window is equal to a window length of the initial linear prediction analysis window, and performing linear prediction analysis on a to-be-processed sound channel signal based on the modified linear prediction analysis window.

Because the values of the at least some points from the point (L−sub_window_len) to the point (L−1) in the modified linear prediction analysis window are less than the values of the corresponding points from the point (L−sub_window_len) to the point (L−1) in the linear prediction analysis window, impact made by a manually reconstructed signal (where the reconstructed signal may include a transition segment signal and a forward signal) on a target sound channel in the current frame can be reduced during linear prediction such that impact of an error between the manually reconstructed signal and a real signal on accuracy of a linear prediction analysis result is reduced. Therefore, a difference between a linear prediction coefficient obtained through linear prediction analysis and a real linear prediction coefficient can be reduced, and accuracy of linear prediction analysis can be improved.

With reference to the first aspect, in some implementations of the first aspect, a value of any point from the point (L−sub_window_len) to the point (L−1) in the modified linear prediction analysis window is less than a value of a corresponding point from the point (L−sub_window_len) to the point (L−1) in the initial linear prediction analysis window.

With reference to the first aspect, in some implementations of the first aspect, the determining a window length of an attenuation window in a current frame based on an inter-channel time difference in the current frame includes determining the window length of the attenuation window in the current frame based on the inter-channel time difference in the current frame and a preset length of a transition segment.

With reference to the first aspect, in some implementations of the first aspect, the determining the window length of the attenuation window in the current frame based on the inter-channel time difference in the current frame and a preset length of a transition segment includes determining a sum of an absolute value of the inter-channel time difference in the current frame and the preset length of the transition segment as the window length of the attenuation window in the current frame.

With reference to the first aspect, in some implementations of the first aspect, the determining the window length of the attenuation window in the current frame based on the inter-channel time difference in the current frame and a preset length of a transition segment includes, when an absolute value of the inter-channel time difference in the current frame is greater than or equal to the preset length of the transition segment, determining a sum of the absolute value of the inter-channel time difference in the current frame and the preset length of the transition segment as the window length of the attenuation window in the current frame, or when an absolute value of the inter-channel time difference in the current frame is less than the preset length of the transition segment, determining N times of the absolute value of the inter-channel time difference in the current frame as the window length of the attenuation window in the current frame, where N is a preset real number greater than 0 and less than L/MAX_DELAY, and MAX_DELAY is a preset real number greater than 0.

Optionally, MAX_DELAY is a maximum value of the absolute value of the inter-channel time difference. It should be understood that the inter-channel time difference herein may be an inter-channel time difference that is preset during encoding/decoding of a stereo signal.

With reference to the first aspect, in some implementations of the first aspect, the determining a modified linear prediction analysis window based on the window length of the attenuation window in the current frame includes modifying the initial linear prediction analysis window based on the window length of the attenuation window in the current frame, where attenuation values of values of the point (L−sub_window_len) to the point (L−1) in the modified linear prediction analysis window relative to values of corresponding points from the point (L−sub_window_len) to the point (L−1) in the initial linear prediction analysis window show a rising trend.

The attenuation value may be an attenuation value of a value of a point in the modified linear prediction analysis window relative to a value of a corresponding point in the initial linear prediction analysis window.

Further, for example, a first point is any point from the point (L−sub_window_len) to the point (L−1) in the modified linear prediction analysis window, and a second point is a point that is in the linear prediction analysis window and that corresponds to the first point. In this case, the attenuation value may be an attenuation value of a value of the first point relative to a value of the second point.

When delay alignment processing is performed on a sound channel signal, a forward signal on the target sound channel in the current frame needs to be manually reconstructed. However, in the manually reconstructed forward signal, an estimated signal value of a point farther away from a real signal on the target sound channel in the current frame is more inaccurate. However, the modified linear prediction analysis window acts on the manually reconstructed forward signal. Therefore, when the forward signal is processed using the modified linear prediction analysis window in this application, a proportion of a signal that is in the manually reconstructed forward signal and that corresponds to the point farther away from the real signal in linear prediction analysis can be reduced such that accuracy of linear prediction can be further improved.

With reference to the first aspect, in some implementations of the first aspect, the modified linear prediction analysis window meets a formula $$w_{adp}(i) = \begin{cases} w(i), \ i = 0, 1, \ldots, L - \text{sub_window_len} - 1 \\ w(i) - [i - (L - \text{sub_window_len})] * \text{delta}, \\ \quad i = L - \text{sub_window_len}, \ldots, L - 1, \end{cases}$$

where $w_{adp}(i)$ represents the modified linear prediction analysis window, w (i) represents the initial linear prediction analysis window, $$\text{delta} = \frac{\text{MAX_ATTEN}}{\text{sub_window_len} - 1},$$

and MAX_ATTEN is a preset real number greater than 0.

It should be understood that MAX_ATTEN may be a maximum attenuation value of a plurality of attenuation values that are preset during encoding/decoding of a sound channel signal.

With reference to the first aspect, in some implementations of the first aspect, the determining a modified linear prediction analysis window based on the window length of the attenuation window in the current frame includes determining the attenuation window in the current frame based on the window length of the attenuation window in the current frame, and modifying the initial linear prediction analysis window based on the window length of the attenuation window in the current frame, where attenuation values of values of the point (L−sub_window_len) to the point (L−1) in the modified linear prediction analysis window relative to values of corresponding points from the point (L−sub_window_len) to the point (L−1) in the initial linear prediction analysis window show a rising trend.

With reference to the first aspect, in some implementations of the first aspect, the determining the attenuation window in the current frame based on the window length of the attenuation window in the current frame includes determining the attenuation window in the current frame from a plurality of prestored candidate attenuation windows based on the window length of the attenuation window in the current frame, where the plurality of candidate attenuation windows correspond to different window length value ranges, and there is no intersection set between the different window length value ranges.

The attenuation window in the current frame is determined from the plurality of prestored candidate attenuation windows such that calculation complexity for determining the attenuation window can be reduced.

Further, after corresponding attenuation windows are separately calculated based on window lengths of preselected attenuation windows corresponding to window lengths of attenuation windows within different value ranges, the attenuation windows corresponding to the window lengths of the attenuation windows within the different value ranges may be stored. In this way, after the window length of the attenuation window in the current frame is subsequently determined, the attenuation window in the current frame can be directly determined from the plurality of prestored attenuation windows based on a value range that the window length of the attenuation window in the current frame meets. This can reduce a calculation process and simplify calculation complexity.

It should be understood that, when the attenuation window is calculated, the window lengths of the pre-selected attenuation windows may be all possible values of the window length of the attenuation window or a subset of all possible values of the window length of the attenuation window.

With reference to the first aspect, in some implementations of the first aspect, the attenuation window in the current frame meets a formula $$\text{sub_window}(i) = i^* \frac{\text{MAX_ATTEN}}{\text{sub_window_len} - 1},\ i = 0, 1, \ldots,$$

sub_window_len−1, where sub_window (i) represents the attenuation window in the current frame, and MAX_ATTEN is a preset real number greater than 0.

It should be understood that MAX_ATTEN may be a maximum attenuation value of a plurality of attenuation values that are preset during encoding/decoding of a sound channel signal.

With reference to the first aspect, in some implementations of the first aspect, the modified linear prediction analysis window meets a formula $$w_{adp}(i) = \begin{cases} w(i),\ i = 0, 1, \ldots, L - \text{sub_window_len} - 1 \\ w(i) - \text{sub_window}(i - (L - \text{sub_window_len})), \\ \quad i = L - \text{sub_window_len}, \ldots, L - 1, \end{cases}$$

where $w_{adp}(i)$ represents a window function of the modified linear prediction analysis window, w(i) represents the initial linear prediction analysis window, and sub_window(.) represents the attenuation window in the current frame.

With reference to the first aspect, in some implementations of the first aspect, the determining a modified linear prediction analysis window based on the window length of the attenuation window in the current frame includes determining the modified linear prediction analysis window from a plurality of prestored candidate linear prediction analysis windows based on the window length of the attenuation window in the current frame, where the plurality of candidate linear prediction analysis windows correspond to different window length value ranges, and there is no intersection set between the different window length value ranges.

The modified linear prediction analysis window is determined from the plurality of prestored candidate linear prediction analysis windows such that calculation complexity for determining the modified linear prediction analysis window can be reduced.

Further, after corresponding modified linear prediction analysis windows are separately calculated based on the initial linear prediction analysis window and window lengths of pre-selected attenuation windows corresponding to the window lengths of the attenuation windows within different value ranges, the modified linear prediction analysis windows corresponding to the window lengths of the attenuation windows within different value ranges may be stored. In this way, after the window length of the attenuation window in the current frame is subsequently determined, the modified linear prediction analysis window can be directly determined from the plurality of prestored linear prediction analysis windows based on a value range that the window length of the attenuation window in the current frame meets. This can reduce a calculation process and simplify calculation complexity.

Optionally, when the modified linear prediction analysis window is calculated, the window lengths of the pre-selected attenuation windows may be all possible values of the window length of the attenuation window or a subset of all possible values of the window length of the attenuation window.

With reference to the first aspect, in some implementations of the first aspect, before the determining a modified linear prediction analysis window based on the window length of the attenuation window in the current frame, the method further includes modifying the window length of the attenuation window in the current frame based on a preset interval step, to obtain a modified window length of the attenuation window, where the interval step is a preset positive integer, and the determining a modified linear prediction analysis window based on the window length of the attenuation window in the current frame includes determining the modified linear prediction analysis window based on the initial linear prediction analysis window and the modified window length of the attenuation window.

Optionally, the interval step is a positive integer less than a maximum value of the window length of the attenuation window.

The window length of the attenuation window in the current frame is modified using the preset interval step such that the window length of the attenuation window can be reduced. In addition, a possible value of the modified window length of the attenuation window is restricted to being included in a set including a limited quantity of values, and it is convenient to store an attenuation window corresponding to the possible value of the modified window length of the attenuation window such that subsequent calculation complexity is reduced.

With reference to the first aspect, in some implementations of the first aspect, the modified window length of the attenuation window meets a formula $$sub_window_len_mod = \lfloor sub_window_len / len_step \rfloor * len_step$$

where sub_window_len_mod represents the modified window length of the attenuation window, and len_step represents the interval step.

With reference to the first aspect, in some implementations of the first aspect, the determining the modified linear prediction analysis window based on the initial linear prediction analysis window and the modified window length of the attenuation window includes modifying the initial linear prediction analysis window based on the modified window length of the attenuation window.

With reference to the first aspect, in some implementations of the first aspect, the determining the modified linear prediction analysis window based on the initial linear prediction analysis window and the modified window length of the attenuation window includes determining the attenuation window in the current frame based on the modified window length of the attenuation window, and modifying the initial linear prediction analysis window in the current frame based on the modified attenuation window.

With reference to the first aspect, in some implementations of the first aspect, the determining the attenuation window in the current frame based on the modified window length of the attenuation window includes determining the attenuation window in the current frame from a plurality of prestored candidate attenuation windows based on the modified window length of the attenuation window, where the plurality of prestored candidate attenuation windows are attenuation windows corresponding to different values of the modified window length of the attenuation windows.

After corresponding attenuation windows are calculated based on window lengths of a group of pre-selected modified attenuation windows, attenuation windows corresponding to the window lengths of pre-selected modified attenuation windows may be stored. In this way, after the modified window length of the attenuation window is subsequently determined, the attenuation window in the current frame can be directly determined from the plurality of prestored candidate attenuation windows based on the modified window length of the attenuation window. This can reduce a calculation process and simplify calculation complexity.

It should be understood that, the window lengths of the pre-selected modified attenuation windows herein may be all possible values of the modified window length of the attenuation window or a subset of all possible values of the modified window length of the attenuation window.

With reference to the first aspect, in some implementations of the first aspect, the determining the modified linear prediction analysis window based on the initial linear prediction analysis window in the current frame and the modified window length of the attenuation window includes determining the modified linear prediction analysis window from a plurality of prestored candidate linear prediction analysis windows based on the modified window length of the attenuation window, where the plurality of prestored candidate linear prediction analysis windows correspond modified linear prediction analysis windows when the modified window lengths of the attenuation windows are of different values.

After corresponding modified linear prediction analysis windows are separately calculated based on the initial linear prediction analysis window in the current frame and window lengths of a group of pre-selected modified attenuation windows, the modified linear prediction analysis windows corresponding to the window lengths of the pre-selected modified attenuation windows may be stored. In this way, after the modified window length of the attenuation window is subsequently determined, the modified linear prediction analysis window can be directly determined from the plurality of prestored candidate linear prediction analysis windows based on the window lengths of the modified attenuation windows in the current frame. This can reduce a calculation process and simplify calculation complexity.

Optionally, the window lengths of the pre-selected modified attenuation windows herein are all possible values of the modified window length of the attenuation window or a subset of all possible values of the modified window length of the attenuation window.

According to a second aspect, an encoding apparatus is provided. The encoding apparatus includes a module configured to perform the method in the first aspect or the various implementations of the first aspect.

According to a third aspect, an encoding apparatus is provided, including a memory and a processor. The memory is configured to store a program, and the processor is configured to execute the program. When the program is executed, the processor performs the method in any one of the first aspect or the implementations of the first aspect.

According to a fourth aspect, a computer readable storage medium is provided. The computer readable storage medium is configured to store program code executed by a device, and the program code includes an instruction used to perform the method in the first aspect or the various implementations of the first aspect.

According to a fifth aspect, a chip is provided. The chip includes a processor and a communications interface. The communications interface is configured to communicate with an external component, and the processor is configured to perform the method in any one of the first aspect or the possible implementations of the first aspect.

Optionally, in an implementation, the chip may further include a memory. The memory stores an instruction, and the processor is configured to execute the instruction stored in the memory. When the instruction is executed, the processor is configured to perform the method in any one of the first aspect or the possible implementations of the first aspect.

Optionally, in an implementation, the chip is integrated into a terminal device or a network device.

DESCRIPTION OF EMBODIMENTS

The following describes technical solutions of this application with reference to accompanying drawings.

Figure 1:
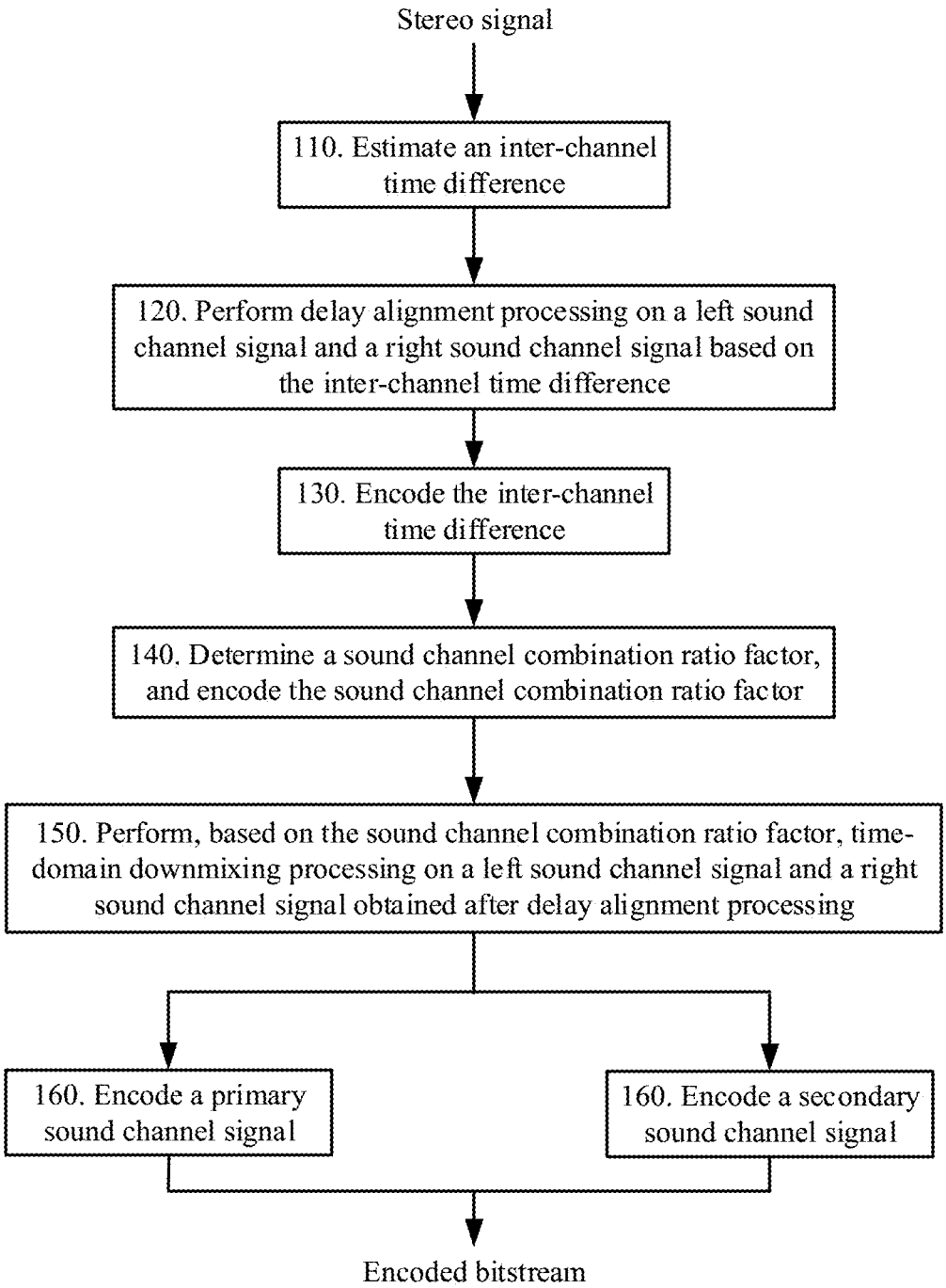
FIG. 1 is a schematic flowchart of a time-domain stereo encoding method.
Figure 2:
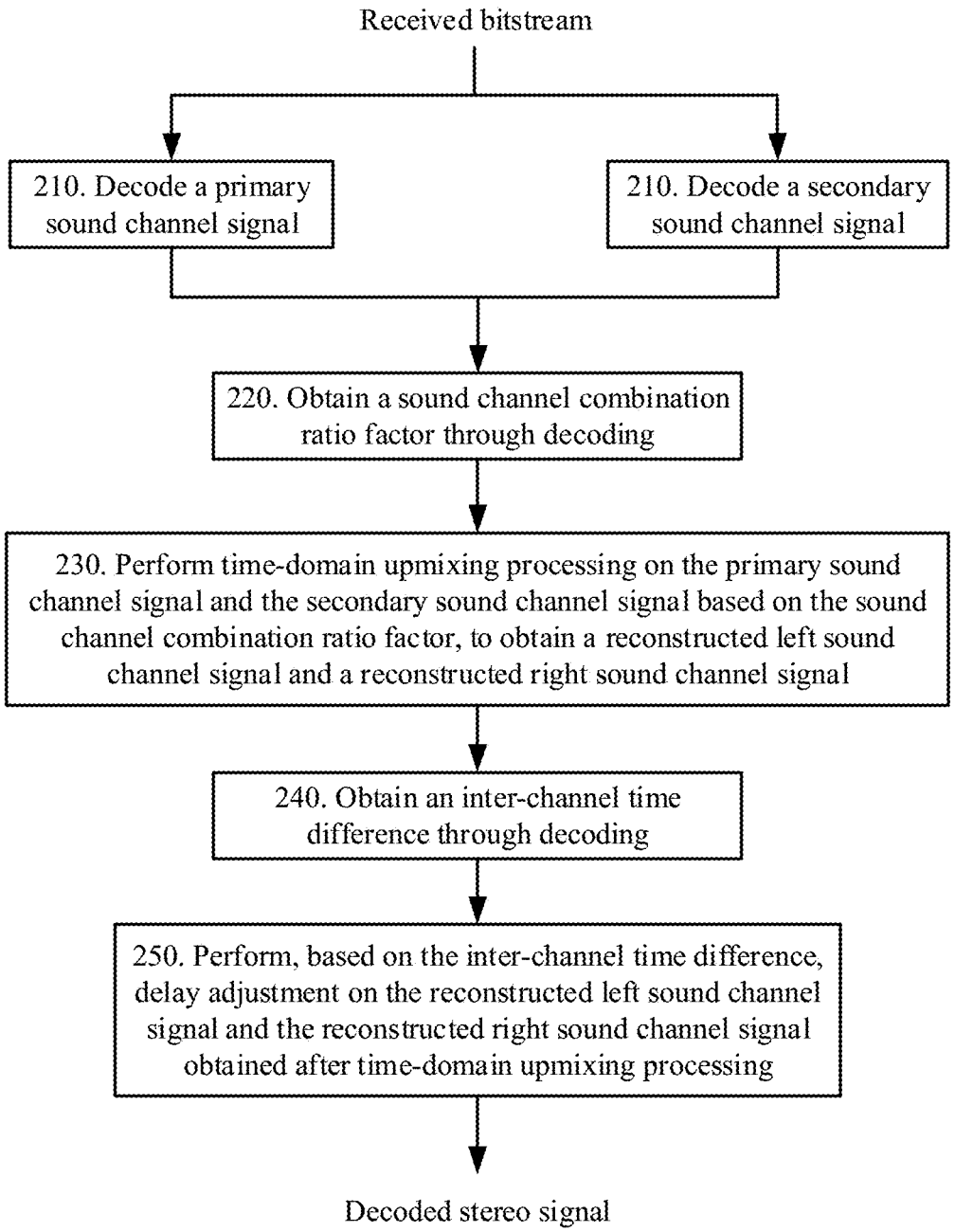
FIG. 2 is a schematic flowchart of a time-domain stereo decoding method.

To facilitate understanding of a stereo signal encoding method in the embodiments of this application, the following first briefly describes a general encoding/decoding process of a time-domain stereo encoding/decoding method with reference to FIG. 1 and FIG. 2.

FIG. 1 is a schematic flowchart of a time-domain stereo encoding method. The encoding method 100 further includes the following steps.

110. An encoder side estimates an inter-channel time difference of a stereo signal to obtain the inter-channel time difference of the stereo signal.

The stereo signal includes a left sound channel signal and a right sound channel signal, and the inter-channel time difference of the stereo signal is a time difference between the left sound channel signal and the right sound channel signal.

120. Perform delay alignment processing on the left sound channel signal and the right sound channel signal based on the inter-channel time difference.

130. Encode the inter-channel time difference of the stereo signal, to obtain an encoding index of the inter-channel time difference, and write the encoding index into a stereo encoded bitstream.

140. Determine a sound channel combination ratio factor, encode the sound channel combination ratio factor, to obtain an encoding index of the sound channel combination ratio factor, and write the encoding index into the stereo encoded bitstream.

150. Perform, based on the sound channel combination ratio factor, time-domain downmixing processing on a left sound channel signal and a right sound channel signal obtained after delay alignment processing.

160. Separately encode a primary sound channel signal and a secondary sound channel signal obtained after downmixing processing, to obtain a bitstream including the primary sound channel signal and the secondary sound channel signal, and write the bitstream into a stereo encoded bitstream.

FIG. 2 is a schematic flowchart of a time-domain stereo decoding method. The encoding method 200 further includes the following steps.

210. Obtain a primary sound channel signal and a secondary sound channel signal through decoding based on a received bitstream.

The bitstream in step 210 may be received by a decoder side from an encoder side. In addition, step 210 is equivalent to separately decoding the primary sound channel signal and the secondary sound channel signal, to obtain the primary sound channel signal and the secondary sound channel signal.

220. Obtain a sound channel combination ratio factor through decoding based on the received bitstream.

230. Perform time-domain upmixing processing on the primary sound channel signal and the secondary sound channel signal based on the sound channel combination ratio factor, to obtain a reconstructed left sound channel signal and a reconstructed right sound channel signal obtained after time-domain upmixing processing.

240. Obtain an inter-channel time difference through decoding based on the received bitstream.

250. Perform, based on the inter-channel time difference, delay adjustment on the reconstructed left sound channel signal and the reconstructed right sound channel signal obtained after time-domain upmixing processing, to obtain a decoded stereo signal.

When delay alignment processing is performed in step 120 in the method 100, a forward signal on a target sound channel in a current frame needs to be manually reconstructed. However, the manually reconstructed forward signal and a real forward signal on the target sound channel in the current frame differ greatly. Therefore, during linear prediction analysis, because of the manually reconstructed forward signal, a linear prediction coefficient obtained through linear prediction analysis when the primary sound channel signal and the secondary sound channel signal obtained after downmixing processing are separately encoded in step 160 is inaccurate, and the linear prediction coefficient obtained through linear prediction analysis and a real linear prediction coefficient differ to some extent. Therefore, a new stereo signal encoding method needs to be provided. The encoding method can improve accuracy of linear prediction analysis, and reduce a difference between the linear prediction coefficient obtained through linear prediction analysis and the real linear prediction coefficient.

Therefore, this application provides a new stereo encoding method. In the method, an initial linear prediction analysis window is modified such that a value of a point that is in a modified linear prediction analysis window and that corresponds to a manually reconstructed forward signal on a target sound channel in a current frame is less than a value of a point that is in a to-be-modified linear prediction analysis window and that corresponds to the manually reconstructed forward signal on the target sound channel in the current frame. Therefore, during linear prediction, impact of the manually reconstructed forward signal on the target sound channel in the current frame can be reduced, and impact of an error between the manually reconstructed forward signal and a real forward signal on accuracy of a linear prediction analysis result is reduced. In this way, a difference between a linear prediction coefficient obtained through linear prediction analysis and a real linear prediction coefficient can be reduced, and accuracy of linear prediction analysis can be improved.

Figure 3:
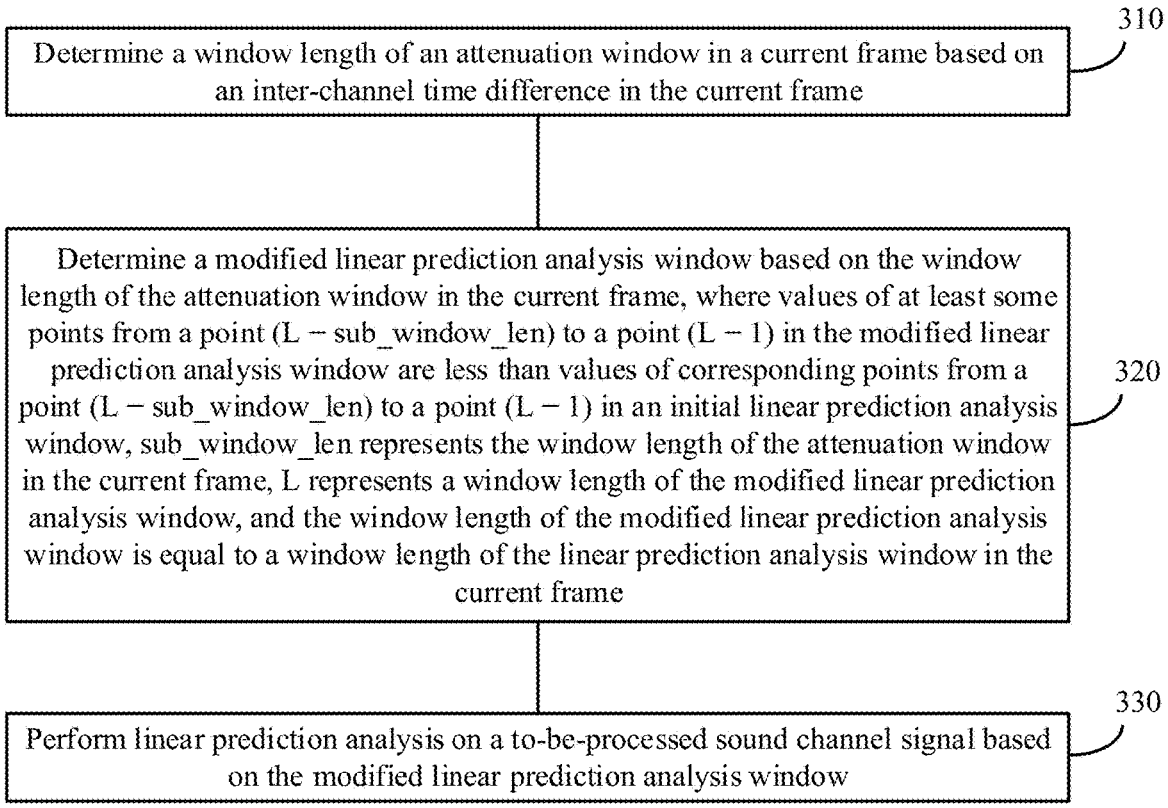
FIG. 3 is a schematic flowchart of a stereo signal encoding method according to an embodiment of this application.

FIG. 3 is a schematic flowchart of an encoding method according to an embodiment of this application. The method 300 may be performed by an encoder side. The encoder side may be an encoder or a device having a function of encoding a stereo signal. It should be understood that, the method 300 may be a part of an entire process of encoding the primary sound channel signal and the secondary sound channel signal obtained after downmixing processing in step 160 in the method 100. Specifically, the method 300 may be a process of performing linear prediction on the primary sound channel signal or the secondary sound channel signal obtained after downmixing processing in step 160.

The method 300 further includes the following steps.

310. Determine a window length of an attenuation window in a current frame based on an inter-channel time difference in the current frame.

Optionally, a sum of an absolute value of the inter-channel time difference in the current frame and a preset length of a transition segment (the transition segment is located between a real signal and a manually reconstructed forward signal in the current frame) in the current frame may be directly determined as the window length of the attenuation window.

Further, the window length of the attenuation window in the current frame may be determined according to Formula (1)

$$sub_window_len = \mathrm{abs}(cur_itd) + Ts2 \quad (1).$$

In Formula (1), sub_window_len represents the window length of the attenuation window, cur_itd represents the inter-channel time difference in the current frame, abs(cur_itd) represents the absolute value of the inter-channel time difference in the current frame, and Ts2 represents the length of the transition segment that is preset for enhancing smoothness transition between a real signal in the current frame and a manually reconstructed forward signal.

It can be learned from Formula (1) that a maximum value of the window length of the attenuation window meets Formula (2)

$$\text{MAX_}WIN_LEN=\text{MAX_DELAY}+Ts2 \quad (2).$$

MAX_WIN_LEN represents the maximum value of the window length of the attenuation window, a meaning of Ts2 in Formula (2) is the same as the meaning of Ts2 in Formula (1), and MAX_DELAY is a preset real number greater than 0. Further, MAX_DELAY may be an obtainable maximum value of the absolute value of the inter-channel time difference. For different codecs, the obtainable maximum value of the absolute value of the inter-channel time difference may be different, and MAX_DELAY may be set as required by a user or a codec manufacturer. It can be understood that, when a codec works, a specific value of MAX_DELAY is already a determined value.

For example, when a sampling rate of a stereo signal is 16 kHz, MAX_DELAY may be 40, and Ts2 may be 10. In this case, it can be learned according to Formula (2) that the maximum value MAX_WIN_LEN of the window length of the attenuation window in the current frame is 50.

Optionally, the window length of the attenuation window in the current frame may be determined depending on a result of comparison between the absolute value of the inter-channel time difference in the current frame and the preset length of the transition segment in the current frame.

Further, when the absolute value of the inter-channel time difference in the current frame is greater than or equal to the preset length of the transition segment in the current frame, the window length of the attenuation window in the current frame is a sum of the absolute value of the inter-channel time difference in the current frame and the preset length of the transition segment, or when the absolute value of the inter-channel time difference in the current frame is less than the preset length of the transition segment in the current frame, the window length of the attenuation window in the current frame is N times of the absolute value of the inter-channel time difference in the current frame. Theoretically, N may be any preset real number greater than 0 and less than L/MAX_DELAY. Generally, N may be a preset integer greater than 0 and less than or equal to 2.

Further, the window length of the attenuation window in the current frame may be determined according to Formula (3)

$$\text{sub_window_len}=\begin{cases}\text{abs(cur_itd)}+Ts2, & \text{abs(cur_itd)}\geq Ts2\\ N^{*}\text{abs(cur_itd)}, & \text{abs(cur_itd)}<Ts2\end{cases}. \quad (3)$$

In Formula (3), sub_window_len represents the window length of the attenuation window, cur_itd represents the inter-channel time difference in the current frame, abs(cur_itd) represents the absolute value of the inter-channel time difference in the current frame, Ts2 represents the length of the transition segment that is preset for enhancing smoothness transition between the real signal and the manually reconstructed forward signal in the current frame, and N is a preset real number greater than 0 and less than L/MAX_DELAY. Preferably, N is a preset integer greater than 0 and less than or equal to 2, for example, N is 2.

Optionally, Ts2 is a preset positive integer. For example, when a sampling rate is 16 kHz, Ts2 is 10. In addition, with regard to different sampling rates of a stereo signal, Ts2 may be set to a same value or different values.

When the window length of the attenuation window in the current frame is determined according to Formula (3), the maximum value of the window length of the attenuation window meets Formula (4) or Formula (5)

$$\text{MAX_}WIN_LEN=\text{MAX_DELAY}+Ts2 \quad (4),$$

$$\text{MAX_}WIN_LEN=N^{*}\text{MAX_DELAY} \quad (5).$$

For example, when a sampling rate of a stereo signal is 16 kHz, MAX_DELAY may be 40, Ts2 may be 10, and N may be 2. In this case, it can be learned according to Formula (4) that the maximum value MAX_WIN_LEN of the window length of the attenuation window in the current frame is 50.

For example, when a sampling rate of a stereo signal is 16 kHz, MAX_DELAY may be 40, Ts2 may be 50, and N may be 2. In this case, it can be learned according to Formula (5) that the maximum value MAX_WIN_LEN of the window length of the attenuation window in the current frame is 80.

320. Determine a modified linear prediction analysis window based on the window length of the attenuation window in the current frame, where values of at least some points from a point (L−sub_window_len) to a point (L−1) in the modified linear prediction analysis window are less than values of corresponding points from the point (L−sub_window_len) to the point (L−1) in an initial linear prediction analysis window, sub_window_len represents the window length of the attenuation window in the current frame, L represents a window length of the modified linear prediction analysis window, and the window length of the modified linear prediction analysis window is equal to a window length of the initial linear prediction analysis window.

Further, a value of any point from the point (L−sub_window_len) to the point (L−1) in the modified linear prediction analysis window is less than a value of a corresponding point from the point (L−sub_window_len) to the point (L−1) in the initial linear prediction analysis window.

A point from the point (L−sub_window_len) to the point (L−1) in the initial linear prediction analysis window corresponding to any point from the point (L−sub_window_len) to the point (L−1) in the modified linear prediction analysis window is a point that is in the initial linear prediction analysis window and that has a same index (index) as the any point. For example, a point in the initial linear prediction analysis window corresponding to the point (L−sub_window_len) in the modified linear prediction analysis window is the point (L−sub_window_len) in the initial linear prediction analysis window.

Optionally, the determining a modified linear prediction analysis window based on the window length of the attenuation window in the current frame further includes modifying the initial linear prediction analysis window based on the window length of the attenuation window in the current frame, to obtain the modified linear prediction analysis window. Further, attenuation values of values of the point (L−sub_window_len) to the point (L−1) in the modified linear prediction analysis window relative to values of corresponding points from the point (L−sub_window_len) to the point (L−1) in the initial linear prediction analysis window show a rising trend.

It should be understood that the attenuation value may be an attenuation value of a value of a point in the modified linear prediction analysis window relative to a value of a corresponding point in the initial linear prediction analysis window. For example, an attenuation value of a value of the point (L−sub_window_len) in the modified linear prediction analysis window relative to a value of a corresponding point in the initial linear prediction analysis window may be specifically determined by determining a difference between the value of the point (L–sub_window_len) in the modified linear prediction analysis window and the value of the point (L–sub_window_len) in the linear prediction analysis window.

For example, a first point is any point from the point (L–sub_window_len) to the point (L–1) in the modified linear prediction analysis window, and a second point is a point that is in the linear prediction analysis window and that corresponds to the first point. In this case, the attenuation value may be a difference between a value of the first point and a value of the second point.

It should be understood that, modifying the initial linear prediction analysis window based on the window length of the attenuation window in the current frame is to decrease values of at least some points from the point (L–sub_window_len) to the point (L–1) in the initial linear prediction analysis window. In other words, after the initial linear prediction analysis window is modified to obtain the modified linear prediction analysis window, the values of the at least some points from the point (L–sub_window_len) to the point (L–1) in the modified linear prediction analysis window are less than values of corresponding points in the initial linear prediction analysis window.

It should be understood that, attenuation values corresponding to all points within a range of the window length of the attenuation window or values of all points in the attenuation window may include 0 or may not include 0. In addition, values of all the points within the range of the window length of the attenuation window and the values of all the points in the attenuation window may be real numbers less than or equal to 0, or may be real numbers greater than or equal to 0.

When the values of all the points in the attenuation window are real numbers less than or equal to 0, when the initial linear prediction analysis window is modified based on the window length of the attenuation window, a value of any point from the point (L–sub_window_len) to the point (L–1) in the initial linear prediction analysis window may be added to a value of a corresponding point in the attenuation window, to obtain a value of a corresponding point in the modified linear prediction analysis window.

However, when the values of all the points in the attenuation window are real numbers greater than or equal to 0, when the initial linear prediction analysis window is modified based on the window length of the attenuation window, a value of any point from the point (L–sub_window_len) to the point (L–1) in the initial linear prediction analysis window may be subtracted from a value of a corresponding point in the attenuation window, to obtain a value of a corresponding point in the modified linear prediction analysis window.

The foregoing two paragraphs describe manners of determining values of corresponding points in the modified linear prediction analysis window in the cases in which the values of all the points in the attenuation window are real numbers greater than or equal to 0 or the values of all the points in the attenuation window are real numbers less than or equal to 0. It should be understood that, when the values of all the points within the range of the window length of the attenuation window are real numbers greater than or equal to 0 or real numbers less than or equal to 0, values of the corresponding points in the modified linear prediction analysis window may also be respectively determined in manners similar to that in the content of the foregoing two paragraphs.

It should also be understood that, when the values of all the points in the attenuation window are non-zero real numbers, after the initial linear prediction analysis window is modified, all the values of the point (L–sub_window_len) to the point (L–1) in the modified linear prediction analysis window are less than values of corresponding points from the point (L–sub_window_len) to the point (L–1) in the initial linear prediction analysis window.

However, when values of some points in the attenuation window all are 0, after the initial linear prediction analysis window is modified, all values of at least some points from the point (L–sub_window_len) to the point (L–1) in the modified linear prediction analysis window are less than values of corresponding points from the point (L–sub_window_len) to the point (L–1) in the initial linear prediction analysis window.

It should be understood that any type of linear prediction analysis window may be selected as the initial linear prediction analysis window in the current frame. Specifically, the initial linear prediction analysis window in the current frame may be a symmetric window or an asymmetric window.

Further, when a sampling rate of a stereo signal is 12.8 kHz, the window length L of the initial linear prediction analysis window may be 320 points. In this case, the initial linear prediction analysis window w(n) meets Formula (6)

$$w(n) = \begin{cases} 0.54 - 0.46\cos\left(\frac{2pn}{2L_1 - 1}\right), & n = 0, 1, L, L_1 - 1 \\ 0.54 - 0.46\cos\left(\frac{2p(L_1 + L_2 - 1 - n)}{2L_2 - 1}\right), & n = L_1, L_1 + 1, L, L_1 + L_2 - 1 \end{cases} \quad (6)$$

$L=L_1+L2$, $L_1=188$, and $L_2=132$.

In addition, there are a plurality of manners of determining the initial linear prediction analysis window. In an embodiment, the initial linear prediction analysis window may be obtained by calculating the initial linear prediction analysis window in real time, or the initial linear prediction analysis window may be directly obtained from prestored linear prediction analysis windows. These prestored linear prediction analysis windows may be calculated and stored in table form.

Compared with the manner of obtaining the initial linear prediction analysis window by calculating the initial linear prediction analysis window in real time, the initial linear prediction analysis window can be quickly obtained in the manner of obtaining the linear prediction analysis window from the prestored linear prediction analysis windows. This reduces calculation complexity and improves encoding efficiency.

When delay alignment processing is performed on a sound channel signal, a forward signal on a target sound channel in the current frame needs to be manually reconstructed. However, in the manually reconstructed forward signal, an estimated signal value of a point farther away from a real signal on the target sound channel in the current frame is more inaccurate. However, the modified linear prediction analysis window acts on the manually reconstructed forward signal. Therefore, when the forward signal is processed using the modified linear prediction analysis window in this application, a proportion of a signal that is in the manually reconstructed forward signal and that corresponds to the point farther away from the real signal in linear prediction analysis can be reduced such that accuracy of linear prediction can be further improved.

Specifically, the modified linear prediction analysis window meets Formula (7), and the modified linear prediction analysis window may be determined according to Formula (7)

$$w_{adp}(i) = \begin{cases} w(i), & i = 0, 1, L, L - \text{sub_window_len} - 1 \\ w(i) - [i - (L - \text{sub_window_len})] * \text{delta}, & i = L - \text{sub_window_len}, L, L - 1 \end{cases} \quad (7)$$

In Formula (7), sub_window_len represents the window length of the attenuation window in the current frame, $w_{adp}(i)$ represents the modified linear prediction analysis window, w (i) represents the initial linear prediction analysis window, L represents the window length of the modified linear prediction analysis window, $$\text{delta} = \frac{\text{MAX_ATTEN}}{\text{sub_window_len} - 1},$$

and MAX_ATTEN is a preset real number greater than 0.

MAX_ATTEN represents a maximum value of attenuation values, and a meaning of MAX_ATTEN in Formula (8) is the same as that in Formula (7).

The modified linear prediction analysis window obtained by modifying the linear prediction analysis window based on the attenuation window in the current frame meets Formula (9). In other words, after the attenuation window is determined according to Formula (8), the modified linear prediction analysis window may be determined according to Formula (9)

$$w_{adp}(i) = \begin{cases} w(i), & i = 0, 1, L, L - \text{sub_window_len} - 1 \\ w(i) - \text{sub_window}(i - (L - \text{sub_window_len})), & i = L - \text{sub_window_len}, L, L - 1 \end{cases} \quad (9)$$

It should be understood that MAX_ATTEN may be specifically a maximum attenuation value that can be obtained when the initial linear prediction analysis window is attenuated during modification of the initial linear prediction analysis window. A value of MAX_ATTEN may be 0.07, 0.08, or the like, and MAX_ATTEN may be preset by a skilled person based on experience.

Optionally, in an embodiment, the determining the modified linear prediction analysis window based on the initial linear prediction analysis window and the window length of the attenuation window in the current frame further includes determining the attenuation window in the current frame based on the window length of the attenuation window, and modifying the initial linear prediction analysis window based on the attenuation window in the current frame, where attenuation values of the values from the point (L−sub_window_len) to the point (L−1) in the modified linear prediction analysis window relative to the values of the corresponding points from the point (L−sub_window_len) to the point (L−1) in the initial linear prediction analysis window show a rising trend. That the attenuation values show a rising trend means that the attenuation values are in a trend, increasing with an increase in an index (index) of a point from the point (L−sub_window_len) to the point (L−1) in the modified linear prediction analysis window. In other words, an attenuation value of the point (L−sub_window_len) is smallest, an attenuation value of the point (L−1) is largest, and an attenuation value of a point N is greater than an attenuation value of a point (N−1), where L-sub_window_len≤N≤L−1.

It should be understood that the attenuation window may be a linear window or a non-linear window.

Specifically, when the attenuation window is determined based on the window length of the attenuation window in the current frame, the attenuation window meets Formula (8), that is, the attenuation window may be determined according to Formula (8)

$$\text{sub_window}(i) = i * \frac{\text{MAX_ATTEN}}{\text{sub_window_len} - 1}, \quad (8)$$

$$i = 0, 1, L, \text{sub_window_len} - 1.$$

In Formula (8) and Formula (9), sub_window_len represents the window length of the attenuation window in the current frame, and sub_window(.) represents the attenuation window in the current frame. Specifically, sub_window(i-(L−sub_window_len)) represents a value of the attenuation window in the current frame at a point i-(L−sub_window_len), $w_{adp}(i)$ represents the modified linear prediction analysis window, w (i) represents the initial linear prediction analysis window, and L represents the window length of the modified linear prediction analysis window.

Optionally, when the attenuation window is determined based on the window length of the attenuation window in the current frame, the attenuation window in the current frame may be specifically determined from a plurality of prestored candidate attenuation windows based on the window length of the attenuation window in the current frame. The plurality of candidate attenuation windows correspond to different window length value ranges, and there is no intersection set between the different window length value ranges.

The attenuation window in the current frame is determined from the plurality of prestored candidate attenuation windows such that calculation complexity for determining the attenuation window can be reduced. Then the modified linear prediction analysis window may be directly determined from the plurality of prestored attenuation windows.

Specifically, after corresponding attenuation windows are separately calculated based on window lengths of pre-selected attenuation windows corresponding to the window lengths of the attenuation windows within different value ranges, the attenuation windows corresponding to the window lengths of the attenuation windows within the different value ranges may be stored. In this way, after the window length of the attenuation window in the current frame is subsequently determined, the attenuation window in the current frame can be directly determined from the plurality of prestored attenuation windows based on a value range that the window length of the attenuation window in the current frame meets. This can reduce a calculation process and simplify calculation complexity.

It should be understood that, when the attenuation window is calculated, the window lengths of the pre-selected attenuation windows may be all possible values of the window length of the attenuation window or a subset of all possible values of the window length of the attenuation window.

Specifically, it is assumed that, when the window length of the attenuation window is 20, a corresponding attenuation window is denoted as sub_window_20(i), when the window length of the attenuation window is 40, a corresponding attenuation window is denoted as sub_window_40(i), when the window length of the attenuation window is 60, a corresponding attenuation window is denoted as sub_window_60(i), or when the window length of the attenuation window is 80, a corresponding attenuation window is denoted as sub_window_80(i).

Therefore, when the attenuation window in the current frame is determined from the plurality of prestored attenuation windows based on the window length of the attenuation window in the current frame, if the window length of the attenuation window in the current frame is greater than or equal to 20 and is less than 40, sub_window_20(i) may be determined as the attenuation window in the current frame, if the window length of the attenuation window in the current frame is greater than or equal to 40 and is less than 60, sub_window_40(i) may be determined as the attenuation window of the current frame, if the window length of the attenuation window in the current frame is greater than or equal to 60 and is less than 80, sub_window_60(i) may be determined as the attenuation window of the current frame, or if the window length of the attenuation window in the current frame is greater than or equal to 80, sub_window_80 (i) may be determined as the attenuation window of the current frame.

Specifically, when the attenuation window in the current frame is determined from the plurality of prestored attenuation windows based on the window length of the attenuation window in the current frame, the attenuation window in the current frame may be directly determined from the plurality of prestored attenuation windows based on a value range of the window length of the attenuation window in the current frame. Specifically, the attenuation window in the current frame may be determined according to Formula (10)

$$\text{sub_window}(i) = \begin{cases} \text{sub_window_20}(i), & \text{sub_window_len} < 40,\ i = 0, 1, \ldots, 19 \\ \text{sub_window_40}(i), & 40 \le \text{sub_window_len} < 60,\ i = 0, 1, \ldots, 39 \\ \text{sub_window_60}(i), & 60 \le \text{sub_window_len} < 80,\ i = 0, 1, \ldots, 59 \\ \text{sub_window_80}(i), & 80 \le \text{sub_window_len},\ i = 0, 1, \ldots, 79 \end{cases}, \tag{10}$$

where sub_window(i) represents the attenuation window in the current frame, sub_window_len represents the window length of the attenuation window in the current frame, and sub_window_20(i), sub_window_40(i), sub_window_60(i), and sub_window_80(i) are attenuation windows corresponding to prestored attenuation windows with window lengths of 20, 40, 60, and 80 respectively.

It should be understood that the attenuation window determined according to Formula (10) is a linear window. The attenuation window in this application may be a linear window or a non-linear window.

When the attenuation window is a non-linear window, the attenuation window may be determined according to any one of Formula (11) to Formula (13)

$$\text{sub_window}(\text{sub_window_len} - 1 - i) = \text{MAX_ALLEN} * \left(0.5 + 0.5 * \cos\left(i^* \frac{p}{\text{sub_window_len}}\right)\right),\quad i = 0, 1, L, \text{sub_window_len} - 1 \tag{11}$$

$$\text{sub_window}(\text{sub_window_len} - 1 - i) = \text{MAX_ALLEN} * \cos\left(i^* \frac{p}{2 * \text{sub_window_len}}\right),\quad n = 0, 1, L, \text{sub_window_len} - 1 \tag{12}$$

$$\text{sub_window}(\text{sub_window_len} - 1 - i) = \text{MAX_ALLEN} * \left(\cos\left(i^*_* \frac{p}{2 * \text{sub_window_len}}\right)\right)^2,\quad n = 0, 1, L, \text{sub_window_len} - 1. \tag{13}$$

In Formula (11) to Formula (13), sub_window(i) represents the attenuation window in the current frame, and sub_window_len represents the window length of the attenuation window in the current frame, and a meaning of MAX_ATTEN is the same as that in the foregoing.

It should be understood that, after the attenuation window is determined according to any one of Formula (11) to Formula (13), the modified linear prediction analysis window may also be determined according to Formula (9).

The modified linear prediction analysis window obtained by modifying the linear prediction analysis window based on the attenuation window in the current frame meets Formula (14). In other words, after the attenuation window is determined according to Formula (10), the modified linear prediction analysis window may be determined according to any one of Formula (14) to Formula (17)

$$w_{adp}(i) = \begin{cases} w(i), & i = 0, 1, \ldots, L - 20 - 1 \\ w(i) - \text{sub_window_20}(i - (L - 20)), & i = L - 20, \ldots, L - 1 \end{cases},\quad 20 \le \text{sub_window_len} < 40 \tag{14}$$

-continued $$w_{adp}(i) = \begin{cases} w(i), & i = 0, 1, \ldots, L - 40 - 1 \\ w(i) - \text{sub_window_40}(i - (L - 40)), & i = L - 40, \ldots, L - 1 \end{cases},\quad 40 \le \text{sub_window_len} < 60 \tag{15}$$

$$w_{adp}(i) = \begin{cases} w(i), & i = 0, 1, \ldots, L - 60 - 1 \\ w(i) - \text{sub_window_60}(i - (L - 60)), & i = L - 60, \ldots, L - 1 \end{cases},\quad 60 \le \text{sub_window_len} < 80 \tag{16}$$

$$w_{adp}(i) = \begin{cases} w(i), & i = 0, 1, \ldots, L - 80 - 1 \\ w(i) - \text{sub_window_80}(i - (L - 80)), & i = L - 80, \ldots, L - 1 \end{cases}.\quad 80 \le \text{sub_window_len} \tag{17}$$

In Formula (14) to Formula (17), sub_window_len represents the window length of the attenuation window in the current frame, $w_{adp}(i)$ represents the modified linear prediction analysis window, w(i) represents the initial linear prediction analysis window, and L represents the window length of the modified linear prediction analysis window. sub_window_20(.), sub_window_40(i), sub_window_60(i), and sub_window_80(.) are attenuation windows corresponding to prestored attenuation windows with lengths of 20, 40, 60, and 80 respectively. According to any one of Formula (10) to Formula (13), the attenuation windows corresponding to the cases in which the window lengths of the attenuation windows are 20, 40, 60, and 80 may be calculated and stored in advance.

When the modified linear prediction analysis window is calculated according to any one of Formula (14) to Formula (17), the modified linear prediction analysis window may be determined based on a range of values of the window length of the attenuation window, provided that the window length of the attenuation window of the current frame is known. For example, if the window length of the attenuation window in the current frame is 50, a value of the window length of the attenuation window in the current frame ranges from 40 to 60 (greater than or equal to 40 and less than 60). Therefore, the modified linear prediction analysis window may be determined according to Formula (15). If the window length of the attenuation window in the current frame is 70, a value of the window length of the attenuation window in the current frame ranges from 60 to 80 (greater than or equal to 60 and less than 80). In this case, the modified linear prediction analysis window may be determined according to Formula (16).

330. Perform linear prediction analysis on a to-be-processed sound channel signal based on the modified linear prediction analysis window.

The to-be-processed sound channel signal may be a primary sound channel signal or a secondary sound channel signal. Further, the to-be-processed sound channel signal may be a sound channel signal obtained after time-domain preprocessing is performed on the primary sound channel signal or the secondary sound channel signal. The primary sound channel signal and the secondary sound channel signal may be sound channel signals obtained after downmixing processing.

Performing linear prediction analysis on the to-be-processed sound channel signal based on the modified linear prediction analysis window may be specifically performing windowing processing on the to-be-processed sound channel signal based on the modified linear prediction analysis window, and then calculating (specifically according to a Levinson-Durbin algorithm) a linear prediction coefficient in the current frame based on a signal obtained after windowing processing.

In this application, because the values of the at least some points from the point (L–sub_window_len) to the point (L–1) in the modified linear prediction analysis window are less than the values of the corresponding points from the point (L–sub_window_len) to the point (L–1) in the linear prediction analysis window, impact made by a manually reconstructed signal (where the reconstructed signal may include a transition segment signal and a forward signal) on a target sound channel in the current frame can be reduced during linear prediction such that impact of an error between the manually reconstructed signal and a real forward signal on accuracy of a linear prediction analysis result is reduced. Therefore, a difference between a linear prediction coefficient obtained through linear prediction analysis and a real linear prediction coefficient can be reduced, and accuracy of linear prediction analysis can be improved.

Figure 4:
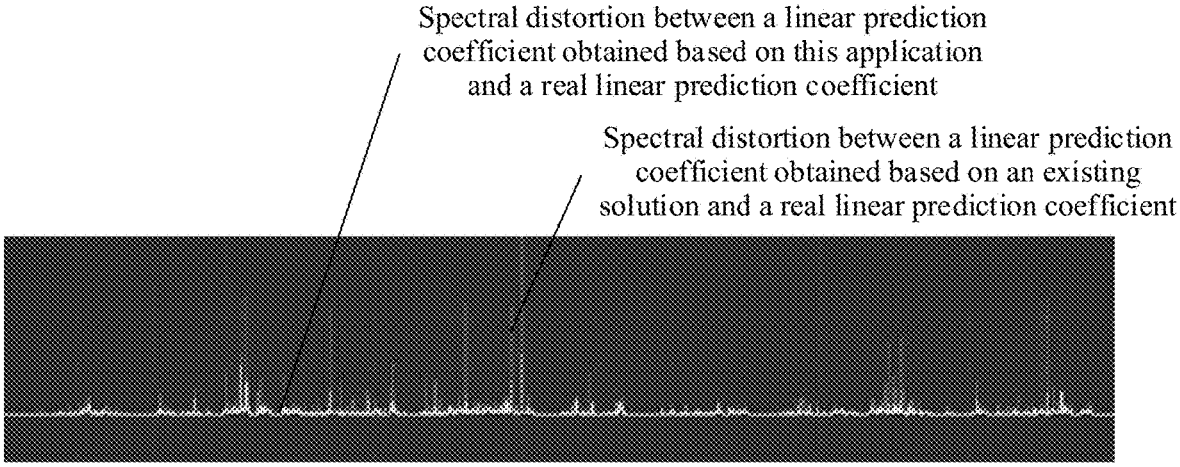
FIG. 4 is a spectral diagram of a difference between a linear prediction coefficient obtained using a stereo signal encoding method and a real linear prediction coefficient according to an embodiment of this application.

Specifically, as shown in FIG. 4, there is comparatively large spectral distortion between a linear prediction coefficient obtained according to an existing solution and a real linear prediction coefficient, while there is comparatively small spectral distortion between a linear prediction coefficient obtained according to this application and a real linear prediction coefficient. Therefore, it can be learned that, according to the stereo signal encoding method in this embodiment of this application, spectral distortion of a linear prediction coefficient obtained during linear prediction analysis can be reduced, thereby improving accuracy of linear prediction analysis.

Optionally, in an embodiment, the determining a modified linear prediction analysis window based on the window length of the attenuation window in the current frame includes determining the modified linear prediction analysis window from a plurality of prestored candidate linear prediction analysis windows based on the window length of the attenuation window in the current frame, where the plurality of candidate linear prediction analysis windows correspond to different window length value ranges, and there is no intersection set between the different window length value ranges.

The plurality of prestored candidate linear prediction analysis windows are modified linear prediction analysis windows corresponding to window lengths of the attenuation windows within different value ranges in the current frame.

Specifically, after corresponding modified linear prediction analysis windows are separately calculated based on the initial linear prediction analysis window and window lengths of pre-selected attenuation windows corresponding to the window lengths of the attenuation windows within different value ranges, the modified linear prediction analysis windows corresponding to the window lengths of the attenuation windows within different value ranges may be stored. In this way, after the window length of the attenuation window in the current frame is subsequently determined, the modified linear prediction analysis window can be directly determined from the plurality of prestored linear prediction analysis windows based on a value range that the window length of the attenuation window in the current frame meets. This can reduce a calculation process and simplify calculation complexity.

Optionally, when the modified linear prediction analysis window is calculated, the window lengths of the pre-selected attenuation windows may be all possible values of the window length of the attenuation window or a subset of all possible values of the window length of the attenuation window.

Specifically, when the modified linear prediction analysis window is determined from the plurality of prestored candidate linear prediction analysis windows based on the window length of the attenuation window in the current frame, the modified linear prediction analysis window may be determined according to Formula (18)

$$w_{adp}(i) = \begin{cases} w(i), & 0 < \text{sub_window_len} < 20 \\ w_{adp}_20(i), & 20 \le \text{sub_window_len} < 40 \\ w_{adp}_40(i), & 40 \le \text{sub_window_len} < 60 \\ w_{adp}_60(i), & 60 \le \text{sub_window_len} < 80 \\ w_{adp}_80(i), & 80 \le \text{sub_window_len} \end{cases} \quad (18)$$

$$i = 0, 1, L, L-1$$

$w_{adp}(i)$ represents the modified linear prediction analysis window, w(i) represents the initial linear prediction analysis window, and $w_{adp_}20(i)$, $w_{adp_}40(i)$, $w_{adp_}60(i)$, and $w_{adp_}80(i)$ are a plurality of prestored linear prediction analysis windows. Specifically, window lengths of attenuation windows corresponding to $w_{adp_}20(i)$, $w_{adp_}40(i)$, $w_{adp_}60(i)$, and $w_{adp_}80(i)$ are 20, 40, 60, and 80 respectively.

When the modified linear prediction analysis window is determined according to Formula (18), after a value of the window length of the attenuation window in the current frame is determined, the modified linear prediction analysis window may be directly determined according to Formula (18) and based on a value range that the window length of the attenuation window of the current frame meets.

Optionally, in an embodiment, before the modified linear prediction analysis window is determined based on the window length of the attenuation window, the method 300 further includes modifying the window length of the attenuation window in the current frame based on a preset interval step, to obtain a modified window length of the attenuation window, where the interval step is a preset positive integer, and the interval step may be a positive integer less than a maximum value of the window length of the attenuation window.

When the window length of the attenuation window is modified, the determining a modified linear prediction analysis window based on the window length of the attenuation window further includes determining the modified linear prediction analysis window based on the initial linear prediction analysis window and the modified window length of the attenuation window.

Specifically, the window length of the attenuation window in the current frame may be first determined based on the inter-channel time difference in the current frame, and then the window length of the attenuation window is modified based on the preset interval step, to obtain the modified window length of the attenuation window.

A window length of an adaptive attenuation window is modified using the preset interval step such that the window length of the attenuation window can be reduced. In addition, a value of the modified window length of the attenuation window is restricted to being included in a set including a limited quantity of constants such that it is convenient to restore the value such that subsequent calculation complexity is reduced.

The modified window length of the attenuation window meets Formula (19). In other words, modifying the window length of the attenuation window based on the preset interval step may be specifically modifying the window length of the attenuation window according to Formula (19)

$$sub_window_len_mod = \lfloor sub_window_len / len_step \rfloor * len_step \tag{19}$$

sub_window_len_mod represents the modified window length of the attenuation window, $\lfloor\rfloor$ represents a rounding down operator, sub_window_len represents the window length of the attenuation window, and len_step represents an interval step, where the interval step may be a positive integer less than a maximum value of the window length of the adaptive attenuation window, for example, 15 or 20, and the interval step may be alternatively preset by a skilled person.

When the maximum value of sub_window_len is 80, and len_step is 20, values of the modified window length of the attenuation window include only 0, 20, 40, 60, and 80, that is, the modified window length of the attenuation window belongs only to {0, 20, 40, 60, 80}. When the modified window length of the attenuation window is 0, the initial linear prediction analysis window is directly used as the modified linear prediction analysis window.

Optionally, in an embodiment, the determining the modified linear prediction analysis window based on the initial linear prediction analysis window and the modified window length of the attenuation window includes modifying the initial linear prediction analysis window based on the modified window length of the attenuation window.

Optionally, in an embodiment, the determining the modified linear prediction analysis window based on the initial linear prediction analysis window and the modified window length of the attenuation window further includes determining the attenuation window in the current frame based on the modified window length of the attenuation window, and modifying the initial linear prediction analysis window of a linear prediction analysis window in the current frame based on the modified attenuation window.

Optionally, in an embodiment, the determining the attenuation window in the current frame based on the modified window length of the attenuation window includes determining the attenuation window in the current frame from a plurality of prestored candidate attenuation windows based on the modified window length of the attenuation window, where the plurality of prestored candidate attenuation windows are attenuation windows corresponding to different values of the modified window length of the attenuation windows.

After corresponding attenuation windows are calculated based on window lengths of a group of pre-selected modified attenuation windows, attenuation windows corresponding to the window lengths of pre-selected modified attenuation windows may be stored. In this way, after the modified window length of the attenuation window is subsequently determined, the attenuation window in the current frame can be directly determined from the plurality of prestored candidate attenuation windows based on the modified window length of the attenuation window. This can reduce a calculation process and simplify calculation complexity.

It should be understood that, the window lengths of the pre-selected modified attenuation windows herein may be all possible values of the modified window length of the attenuation window or a subset of all possible values of the modified window length of the attenuation window.

Specifically, when the attenuation window in the current frame is determined from the plurality of prestored candidate attenuation windows based on the modified window length of the attenuation window in the current frame, the attenuation window in the current frame may be determined according to Formula (20)

$$\text{sub_window}(i) = \begin{cases} \text{sub_window_20}(i),\ i = 0, 1, \ldots, 19,\ \text{sub_window_len_mod} = 20 \\ \text{sub_window}(i) = \text{sub_window_40}(i),\ i = 0, 1, \ldots, 39,\ \text{sub_window_len_mod} = 40 \\ \text{sub_window}(i) = \text{sub_window_60}(i),\ i = 0, 1, \ldots, 59,\ \text{sub_window_len_mod} = 60 \\ \text{sub_window}(i) = \text{sub_window_80}(i),\ i = 0, 1, \ldots, 79,\ \text{sub_window_len_mod} = 80 \end{cases} \tag{20}$$

sub_window(i) represents the attenuation window in the current frame, sub_window_len_mod represents the modified window length of the attenuation window, and sub_window_20(i), sub_window_40(i), sub_window_60(i), and sub_window_80(i) are attenuation windows corresponding to prestored attenuation windows with window lengths of 20, 40, 60, and 80 respectively. When sub_window_len_mod is equal to 0, the initial linear prediction analysis window is directly used as the modified linear prediction analysis window, and therefore the attenuation window in the current frame does not need to be determined.

Optionally, in an embodiment, the determining the modified linear prediction analysis window based on the initial linear prediction analysis window and the modified window length of the attenuation window includes determining the modified linear prediction analysis window from a plurality of prestored candidate linear prediction analysis windows based on the modified window length of the attenuation window, where the plurality of prestored candidate linear prediction analysis windows are modified linear prediction analysis windows corresponding to window lengths of the modified attenuation window of different values.

After corresponding modified linear prediction analysis windows are separately calculated based on the initial linear prediction analysis window and window lengths of a group of pre-selected modified attenuation windows, the modified linear prediction analysis windows corresponding to the window lengths of the pre-selected modified attenuation windows may be stored. In this way, after the modified window length of the attenuation window is subsequently determined, the modified linear prediction analysis window can be directly determined from the plurality of prestored candidate linear prediction analysis windows based on the window lengths of the modified attenuation windows in the current frame. This can reduce a calculation process and simplify calculation complexity.

Optionally, the window lengths of the pre-selected modified attenuation windows herein are all possible values of the modified window length of the attenuation window or a subset of all possible values of the modified window length of the attenuation window.

Specifically, when the modified linear prediction analysis window is determined from the plurality of prestored candidate linear prediction analysis windows based on the modified window length of the attenuation window in the current frame, the modified linear prediction analysis window may be determined according to Formula (21)

$$w_{adp}(i) = \begin{cases} w(i), & \text{sub_window_len} = 0 \\ w_{adp_}20(i), & \text{sub_window_len_mod} = 20 \\ w_{adp_}40(i), & \text{sub_window_len_mod} = 40 \\ w_{adp_}60(i), & \text{sub_window_len_mod} = 60 \\ w_{adp_}80(i), & \text{sub_window_len_mod} = 80 \end{cases}, \quad i = 0, 1, L, L-1 \tag{21}$$

$w_{adp}(i)$ represents the modified linear prediction analysis window, w(i) represents the initial linear prediction analysis window, and $w_{adp_}20(i)$, $w_{adp_}40(i)$, $w_{adp_}60(i)$, and $w_{adp_}80(i)$ are a plurality of prestored linear prediction analysis windows. Specifically, window lengths of attenuation windows corresponding to $w_{adp_}20(i)$, $w_{adp_}40(i)$, $w_{adp_}60(i)$, and $w_{adp_}80(i)$ are 20, 40, 60, and 80 respectively.

It should be understood that the method 300 shown in FIG. 3 is a part of a stereo signal encoding process. To better understand the stereo signal encoding method in this application, the following describes an entire process of the stereo signal encoding method in the embodiments of this application in detail with reference to FIG. 5 to FIG. 10.

Figure 5:
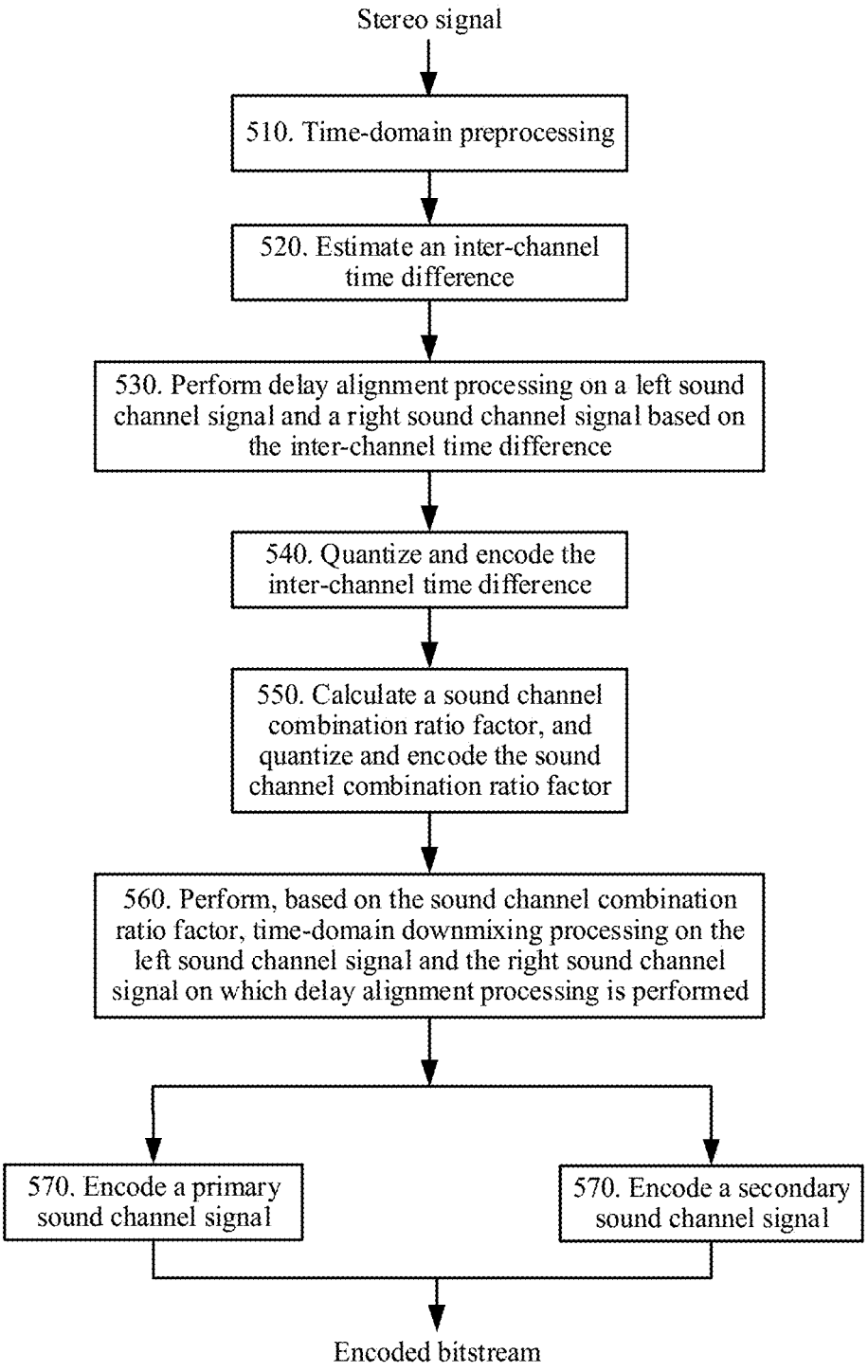
FIG. 5 is a schematic flowchart of a stereo signal encoding method according to an embodiment of this application.

FIG. 5 is a schematic flowchart of a stereo signal encoding method according to an embodiment of this application. The method 500 in FIG. 5 further includes the following steps.

510. Perform time-domain preprocessing on a stereo signal in a current frame.

Specifically, the stereo signal herein is a time-domain signal, and the stereo signal further includes a left sound channel signal and a right sound channel signal. Performing time-domain preprocessing on the stereo signal may be specifically performing high-pass filtering processing on the left sound channel signal and a right sound channel signal in the current frame, to obtain a preprocessed left sound channel signal and a preprocessed right sound channel signal in the current frame. In addition, the time-domain preprocessing herein may be other processing such as pre-emphasis processing, in addition to high-pass filtering processing.

For example, if a sampling rate of a stereo audio signal is 16 HKz, and each frame of signal is 20 ms, a frame length is N=320, that is, each frame includes 320 sampling points. The stereo signal in the current frame includes a left sound channel time-domain signal $X_L$ (n) in the current frame and a right sound channel time-domain signal $x_R$ (n) in the current frame, where n represents a sampling point number, and n=0, 1,L,N−1. Then time-domain preprocessing is performed on the left sound channel time-domain signal $x_L$ (n) in the current frame and the right sound channel time-domain signal $x_R$ (n) in the current frame, to obtain a preprocessed left sound channel time-domain signal $\tilde{x}_L$ (n) in the current frame and a preprocessed right sound channel time-domain signal $\tilde{x}_R$ (n) in the current frame.

520. Estimate an inter-channel time difference between the preprocessed left sound channel time-domain signal and the preprocessed right sound channel time-domain signal, to obtain an inter-channel time difference between the left sound channel signal and the right sound channel signal.

Estimating the inter-channel time difference may be specifically calculating a cross-correlation coefficient between a left sound channel and a right sound channel based on the preprocessed left sound channel signal and the preprocessed right sound channel signal in the current frame, and then an index value corresponding to a maximum value of the cross-correlation coefficient is used as the inter-channel time difference in the current frame.

Specifically, the inter-channel time difference may be estimated in Manner 1 to Manner 3. It should be understood that this application is not limited to using methods in Manner 1 to Manner 3 to estimate the inter-channel time difference, and another approach may be used in this application to estimate the inter-channel time difference.

Manner 1

At a current sampling rate, a maximum value and a minimum value of the inter-channel time difference are $T_{max}$ and $T_{min}$, respectively, where $T_{max}$ and $T_{min}$ are preset real numbers, and $T_{max}>T_{min}$. Therefore, a maximum value of the cross-correlation coefficient between the left sound channel and the right sound channel is searched for between the maximum value and the minimum value of the inter-channel time difference. Finally, an index value corresponding to the found maximum value of the cross-correlation coefficient between the left sound channel and the right sound channel is determined as the inter-channel time difference in the current frame. For example, values of $T_{max}$ and $T_{min}$ may be 40 and −40. Therefore, a maximum value of the cross-correlation coefficient between the left sound channel and the right sound channel is searched for in a range of $-40 \le i \le 40$. Then, an index value corresponding to the maximum value of the cross-correlation coefficient is used as the inter-channel time difference in the current frame.

Manner 2

A maximum value and a minimum value of the inter-channel time difference at a current sampling rate are $T_{max}$ and $T_{min}$, where $T_{max}$ and $T_{min}$ are preset real numbers, and $T_{max} > T_{min}$. Therefore, a cross-correlation function between the left sound channel and the right sound channel may be calculated based on the left sound channel signal and the right sound channel signal in the current frame. Then, smoothness processing is performed on the calculated cross-correlation function between the left sound channel and the right sound channel in the current frame according to a cross-correlation function between the left sound channel and the right sound channel in first L frames (where L is an integer greater than or equal to 1), to obtain the cross-correlation function between a left sound channel and a right sound channel obtained after smoothness processing. Next, a maximum value of a cross-correlation coefficient, obtained after smoothness processing, between the left sound channel and the right sound channel is searched for in a range of $T_{min} \le i \le T_{max}$, and an index value i corresponding to the maximum value is used as the inter-channel time difference in the current frame.

Manner 3

After the inter-channel time difference in the current frame is estimated according to Example 1 or Example 2, inter-frame smoothness processing is performed on inter-channel time differences in M (where M is an integer greater than or equal to 1) frames previous to the current frame and the estimated inter-channel time difference in the current frame, and an inter-channel time difference obtained after smoothness processing is used as a final inter-channel time difference in the current frame.

It should be understood that performing time-domain preprocessing on the left sound channel time-domain signal and the right sound channel time-domain signal in the current frame in step 510 is not a necessary step. If there is no step of performing time-domain preprocessing, the left sound channel signal and the right sound channel signal between which the inter-channel time difference is estimated are a left sound channel signal and a right sound channel signal in a raw stereo signal. The left sound channel signal and the right sound channel signal in the raw stereo signal may be collected pulse code modulation (Pulse Code Modulation, PCM) signals obtained through analog-to-digital (A/D) conversion. In addition, the sampling rate of the stereo audio signal may be 8 kHz, 16 kHz, 32 kHz, 44.1 kHz, 48 kHz, or the like.

530. Perform delay alignment processing on the left sound channel preprocessed time-domain signal and the preprocessed right sound channel time-domain preprocessed signal in the current frame based on the estimated inter-channel time difference.

Specifically, performing delay alignment processing on the left sound channel signal and the right sound channel signal in the current frame may be specifically performing compression or stretching processing on either or both of the left sound channel signal and the right sound channel signal based on the inter-channel time difference in the current frame such that no inter-channel time difference exists between a left sound channel signal and a right sound channel signal obtained after delay alignment processing. The left sound channel signal and the right sound channel signal obtained after delay alignment processing in the current frame are stereo signals obtained after delay alignment processing in the current frame.

When delay alignment processing is performed on the left sound channel signal and the right sound channel signal in the current frame based on the inter-channel time difference, a target sound channel and a reference sound channel in the current frame first need to be selected based on the inter-channel time difference in the current frame and an inter-channel time difference in a previous frame. Then, delay alignment processing may be performed in different manners depending on a result of comparison between an absolute value abs(cur_itd) of the inter-channel time difference in the current frame and an absolute value abs(prev_itd) of the inter-channel time difference in the previous frame of the current frame.

The inter-channel time difference in the current frame is denoted as cur_itd, and the inter-channel time difference in the previous frame is denoted as prev_itd. Specifically, the selecting a target sound channel and a reference sound channel in the current frame based on the inter-channel time difference in the current frame and the inter-channel time difference in the previous frame may be described as follows. If cur_itd=0, the target sound channel in the current frame remains consistent with a target sound channel in the previous frame, if cur_itd<0, the target sound channel in the current frame is a left sound channel, or if cur_itd>0, the target sound channel in the current frame is a right sound channel.

After the target sound channel and the reference sound channel are determined, different manners of delay alignment processing may be used depending on different results of comparison between the absolute value abs(cur_itd) of the inter-channel time difference in the current frame and the absolute value abs(prev_itd) of the inter-channel time difference in the previous frame of the current frame. Specifically, the following three cases are included. It should be understood that, in this application, a processing manner used for delay alignment processing is not limited to a processing manner in the following three cases. In this application, any other delay alignment processing manner in other approaches may be used to perform delay alignment processing.

Case 1 abs(cur_itd) is equal to abs(prev_itd).

Figure 6:
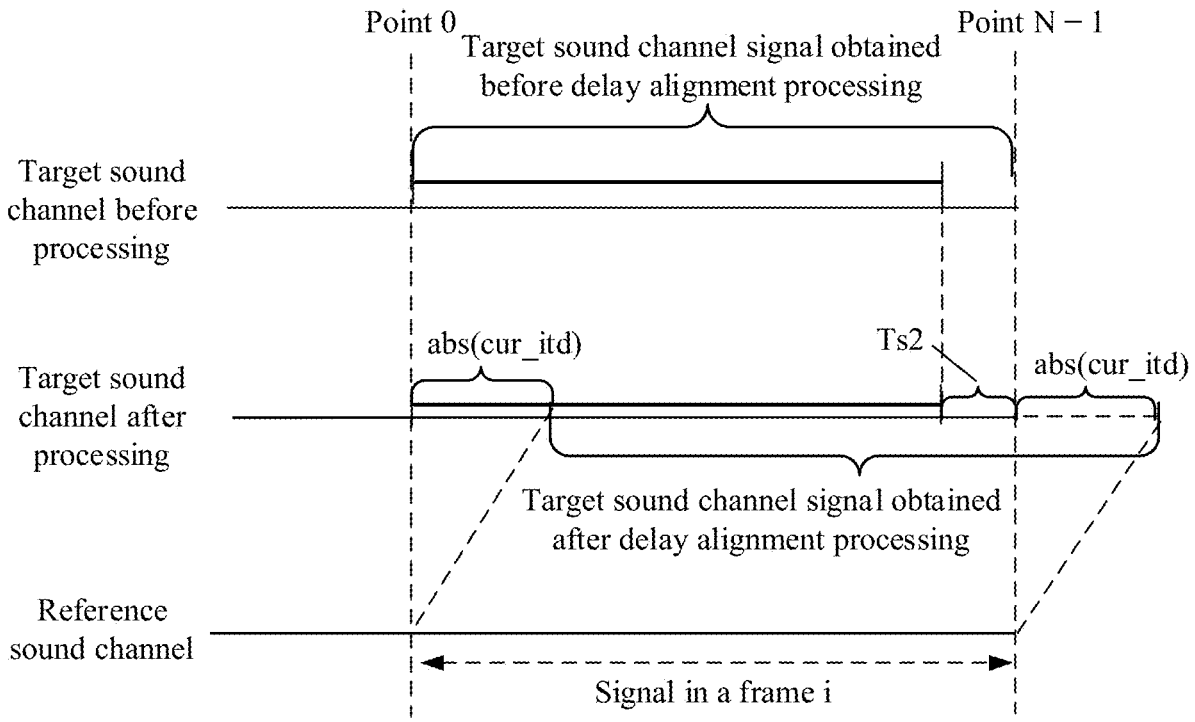
FIG. 6 is a schematic diagram of delay alignment processing according to an embodiment of this application.

When the absolute value of the inter-channel time difference in the current frame is equal to the absolute value of the inter-channel time difference in the previous frame of the current frame, no compression or stretching processing is performed on the target sound channel signal. As shown in FIG. 6, a signal with a length of Ts2 points is generated based on the reference sound channel signal in the current frame and the target sound channel signal in the current frame, and is used as a signal obtained after delay alignment processing from a point (N−Ts2) to a point (N−1) on the target sound channel. In addition, a signal with a length of abs(cur_itd) points is manually reconstructed based on the reference sound channel signal, and is used as a signal obtained after delay alignment processing from a point N to a point (N+abs(cur_itd)−1) on the target sound channel. abs ( ) indicates an operation for obtaining an absolute value, and a frame length of the current frame is N. If a sampling rate is 16 kHz, N=320, and Ts2 is a preset length of a transition segment, for example, Ts2=10.

Finally, after delay alignment processing, a signal with a delay of abs(cur_itd) sampling points on the target sound channel in the current frame is used as the target sound channel signal obtained after delay alignment in the current frame, and the reference sound channel signal in the current frame is directly used as the reference sound channel signal obtained after delay alignment in the current frame.

Case 2 abs(cur_itd) is less than abs(prev_itd).

Figure 7:
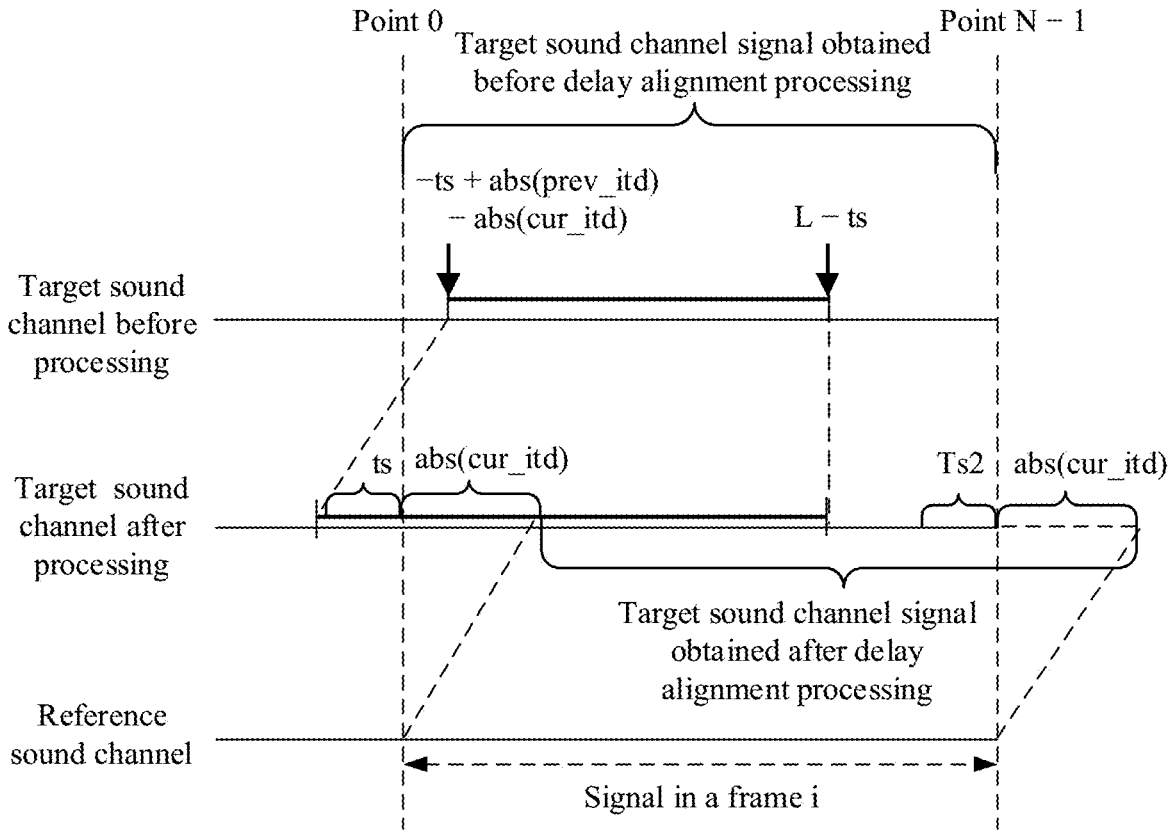
FIG. 7 is a schematic diagram of delay alignment processing according to an embodiment of this application.

As shown in FIG. 7, when the absolute value of the inter-channel time difference in the current frame is less than the absolute value of the inter-channel time difference in the previous frame of the current frame, a buffered target sound channel signal needs to be stretched. Specifically, a signal from a point (−ts+abs(prev_itd)−abs(cur_itd)) to a point (L−ts−1) of the target sound channel signal buffered in the current frame is stretched as a signal with a length of L points, and the signal with the length of L points is used as a signal obtained after delay alignment processing from a point−ts to the point (L−ts−1) on the target sound channel. Then, a signal from a point (L−ts) to a point (N−Ts2−1) of the target sound channel signal in the current frame is directly used as a signal obtained after delay alignment processing from the point (L−ts) to the point (N−Ts2−1) on the target sound channel. Then, a signal with a length of Ts2 points is generated based on the reference sound channel signal and the target sound channel signal in the current frame, and is used as a signal obtained after delay alignment processing from a point (N−Ts2) to a point (N−1) on the target sound channel. Finally, a signal with a length of abs(cur_itd) points is manually reconstructed based on the reference sound channel signal, and is used as a signal obtained after delay alignment processing from a point N to a point (N+abs(cur_itd)−1) on the target sound channel. ts represents a length of an inter-frame smooth transition segment. For example, ts is abs(cur_itd)/2, and L represents a processing length for delay alignment processing. L may be any preset positive integer less than or equal to the frame length N at the current rate, and is generally set to a positive integer greater than an allowable maximum channel time difference. For example, L=290 or L=200. With regard to different sampling rates, the processing length L for delay alignment processing may be set to different values or a same value. Generally, a simplest method is to preset a value of L by a skilled person based on experience, for example, the value is set to 290.

Finally, after delay alignment processing, a signal obtained after delay alignment processing with a length of N points starting from a point abs(cur_itd) on the target sound channel is used as a target sound channel signal obtained after delay alignment in the current frame. The reference sound channel signal in the current frame is directly used as the reference sound channel signal obtained after delay alignment in the current frame.

Case 3 abs(cur_itd) is greater than abs(prev_itd).

Figure 8:
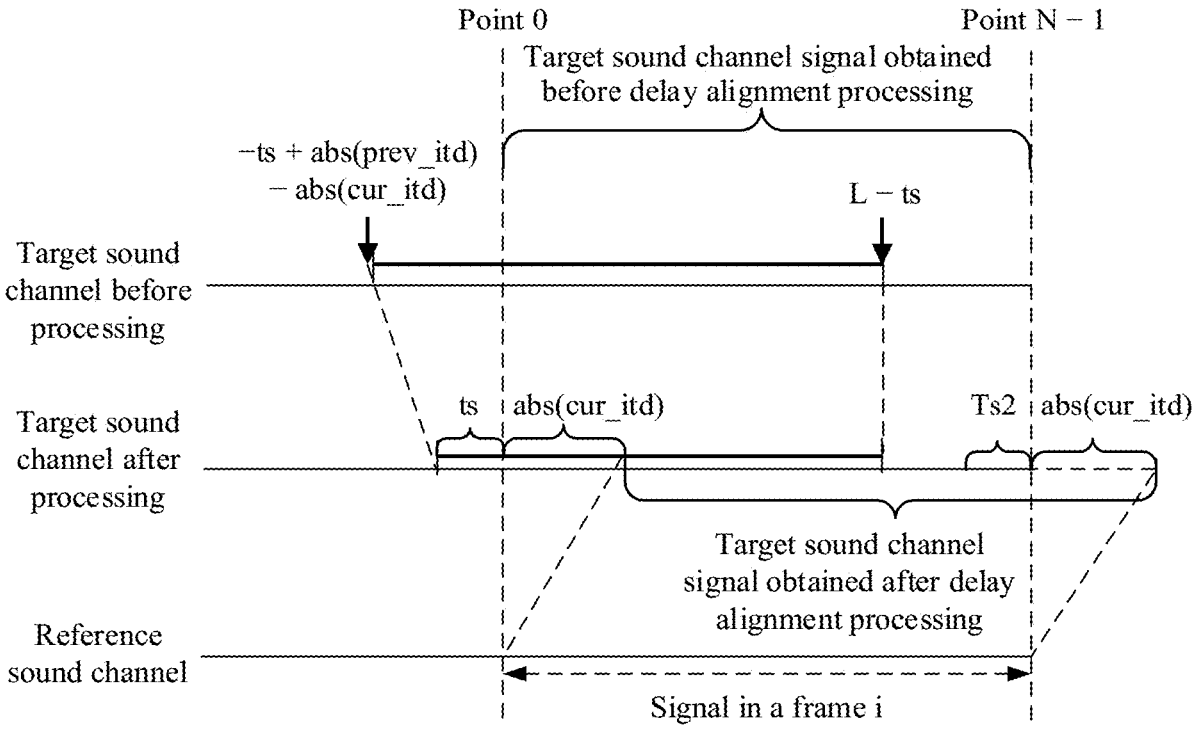
FIG. 8 is a schematic diagram of delay alignment processing according to an embodiment of this application.

As shown in FIG. 8, when the absolute value of the inter-channel time difference in the current frame is less than the absolute value of the inter-channel time difference in the previous frame of the current frame, a buffered target sound channel signal needs to be compressed. Specifically, a signal from a point (−ts+abs(prev_itd)−abs(cur_itd)) to a point (L−ts−1) of the target sound channel signal buffered in the current frame is compressed as a signal with a length of L points, and the signal with the length of L points is used as a signal obtained after delay alignment processing from a point−ts to the point (L−ts−1) on the target sound channel. Then, a signal from a point (L−ts) to a point (N−Ts2−1) of the target sound channel signal in the current frame is directly used as a signal obtained after delay alignment processing from the point (L−ts) to the point (N−Ts2−1) on the target sound channel. Then, a signal with a length of Ts2 points is generated based on the reference sound channel signal and the target sound channel signal in the current frame, and is used as a signal obtained after delay alignment processing from a point (N−Ts2) to a point (N−1) on the target sound channel. Then, a signal with a length of abs(cur_itd) points is generated based on the reference sound channel signal, and is used as a signal obtained after delay alignment processing from a point N to a point (N+abs(cur_itd)−1) on the target sound channel. L still represents a processing length for delay alignment processing.

Finally, after delay alignment processing, a signal obtained after delay alignment processing with a length of N points starting from a point abs(cur_itd) on the target sound channel is still used as a target sound channel signal obtained after delay alignment in the current frame. The reference sound channel signal in the current frame is directly used as the reference sound channel signal obtained after delay alignment in the current frame.

540. Quantize the inter-channel time difference.

Specifically, when quantization is performed on the inter-channel time difference in the current frame, any quantization algorithm in other approaches may be used to perform quantization processing on the inter-channel time difference in the current frame, to obtain a quantization index, and the quantization index is encoded and written into the bitstream.

550. Calculate a sound channel combination ratio factor, and quantize the sound channel combination ratio factor.

There are a plurality of methods for calculating the sound channel combination ratio factor. For example, the sound channel combination ratio factor in the current frame may be calculated based on frame energy on the left sound channel and the right sound channel. A specific process is described as follows.

(1). Calculate frame energy of the left sound channel signal and the right sound channel signal based on a left sound channel signal and a right sound channel signal obtained after delay alignment.

Frame energy rms_L on the left sound channel in the current frame meets $$\text{rms_L} = \frac{1}{N}\sum_{i=0}^{N-1} x'_L(i) * x'_L(i), \text{ where } i = 0, 1, \ldots, N-1 \tag{22}$$

Frame energy rms_R on the right sound channel in the current frame meets $$\text{rms_R} = \frac{1}{N}\sum_{i=0}^{N-1} x'_R(i) * x'_R(i), \text{ where } i = 0, 1, \ldots, N-1 \tag{23}$$

$x'_L(i)$ represents a left sound channel signal obtained after delay alignment in the current frame, $x'_R(i)$ represents a right sound channel signal obtained after delay alignment in the current frame, and i represents a sampling point number.

(2) Calculate the sound channel combination ratio factor in the current frame based on the frame energy on the left sound channel and the right sound channel.

The sound channel combination ratio factor ratio in the current frame meets $$\text{ratio} = \frac{\text{rms_R}}{\text{rms_L} + \text{rms_R}} \tag{24}$$

Therefore, the sound channel combination ratio factor is calculated based on the frame energy of the left sound channel signal and the right sound channel signal.

(3) Quantize the sound channel combination ratio factor, and write the sound channel combination ratio factor on which quantization is performed into a bitstream.

560. Perform, based on the sound channel combination ratio factor, time-domain downmixing processing on the stereo signal obtained after delay alignment in the current frame, to obtain a primary sound channel signal and a secondary sound channel signal.

Specifically, any time-domain downmixing processing method in other approaches may be used to perform time-domain downmixing processing on the stereo signal obtained after delay alignment. However, when time-domain downmixing processing is performed, a corresponding time-domain downmixing processing manner needs to be selected based on a method for calculating the sound channel combination ratio factor, to perform time-domain preprocessing on a stereo signal obtained after delay alignment, to obtain the primary sound channel signal and the secondary sound channel signal.

For example, after the sound channel combination ratio factor ratio is calculated in the manner following step 550, time-domain downmixing processing may be performed based on the sound channel combination ratio factor ratio. For example, the primary sound channel signal and the secondary sound channel signal obtained after time-domain downmixing processing may be determined according to Formula (25)

$$\begin{bmatrix} Y(i) \\ X(i) \end{bmatrix} = \begin{bmatrix} \text{ratio} & 1-\text{ratio} \\ 1\text{-}ratio & -\text{ratio} \end{bmatrix} * \begin{bmatrix} x'_L(i) \\ x'_R(i) \end{bmatrix}, \quad (25)$$

where $i = 0, 1, \ldots, N-1$

Y(i) represents the primary sound channel signal in the current frame, X(i) represents the secondary sound channel signal in the current frame, $x'_L(i)$ represents the left sound channel signal obtained after delay alignment in the current frame, $x'_R(i)$ represents the right sound channel signal obtained after delay alignment in the current frame, i represents a sampling point number, N represents a frame length, and ratio represents the sound channel combination ratio factor.

570. Encode the primary sound channel signal and the secondary sound channel signal.

It should be understood that, encoding processing may be performed, using a mono signal encoding/decoding method on the primary sound channel signal and the secondary sound channel signal obtained after downmixing processing. Specifically, bits to be encoded on a primary sound channel and a secondary sound channel may be allocated based on parameter information obtained in a process of encoding a primary sound channel signal and/or a secondary sound channel signal in a previous frame and a total quantity of bits to be used for encoding the primary sound channel signal and the secondary sound channel signal. Then, the primary sound channel signal and the secondary sound channel signal are separately encoded based on a bit allocation result, to obtain encoding indexes obtained after the primary sound channel signal is encoded and encoding indexes obtained after the secondary sound channel signal is encoded. In addition, algebraic code excited linear prediction (ACELP) of an encoding scheme may be used to encode the primary sound channel signal and the secondary sound channel signal.

It should be understood that, the stereo signal encoding method in this embodiment of this application may be a part of step 570 for encoding the primary sound channel signal and the secondary sound channel signal obtained after downmixing processing in the method 500. Specifically, the stereo signal encoding method in this embodiment of this application may be a process of performing linear prediction on the primary sound channel signal or the secondary sound channel signal obtained after downmixing processing in step 570. There are a plurality of manners of performing linear prediction analysis on the stereo signal in the current frame. Linear prediction analysis may be separately performed on the primary sound channel signal and the secondary sound channel signal in the current frame twice, or linear prediction analysis may be separately performed on the primary sound channel signal and the secondary sound channel signal in the current frame once. The following separately describes the two linear prediction analysis manners in detail with reference to FIG. 9 and FIG. 10.

Figure 9:
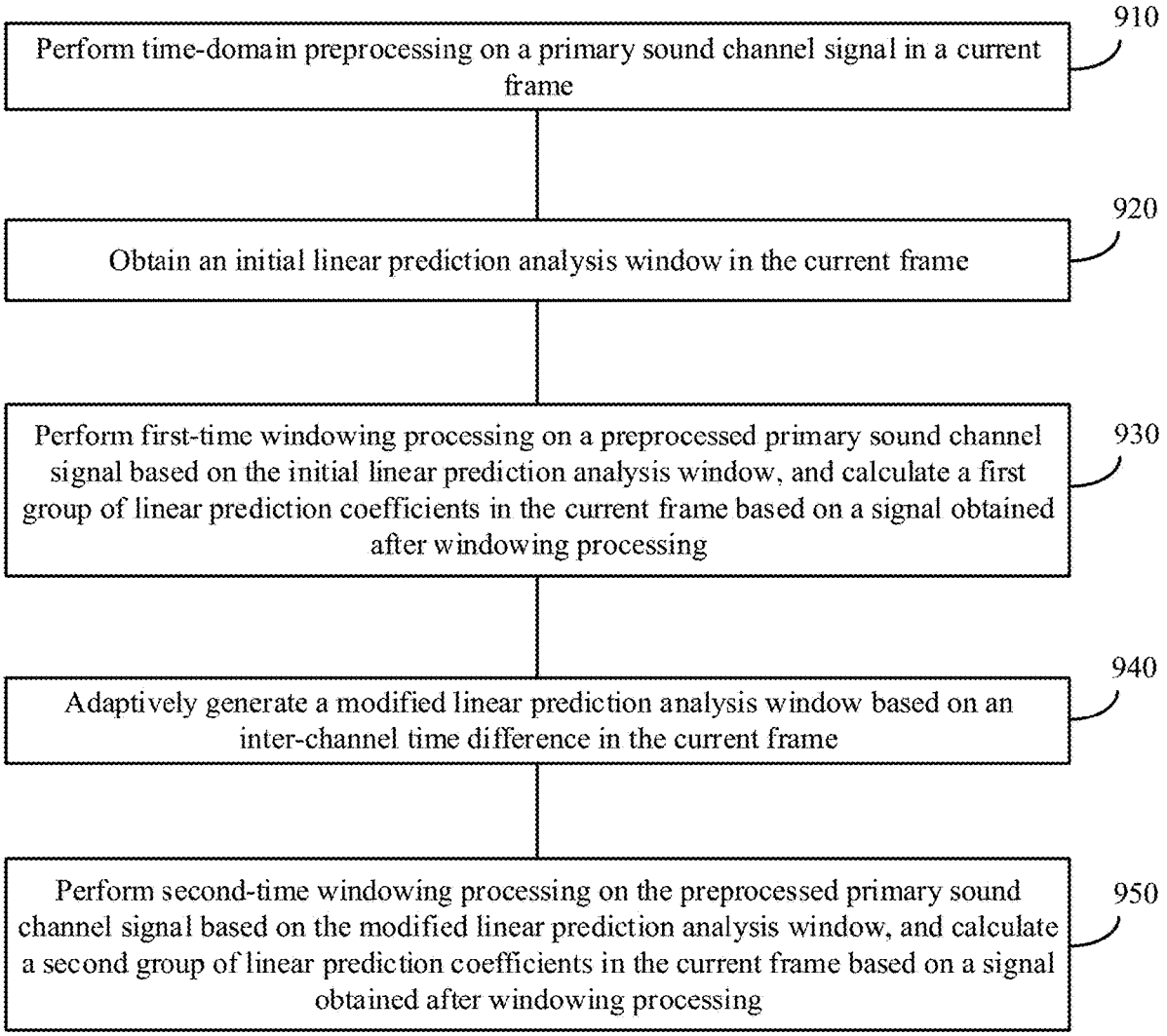
FIG. 9 is a schematic flowchart of a linear prediction analysis process according to an embodiment of this application.

FIG. 9 is a schematic flowchart of a linear prediction analysis process according to an embodiment of this application. The linear prediction process shown in FIG. 9 is to perform linear prediction analysis on a primary sound channel signal in a current frame twice. The linear prediction analysis process shown in FIG. 9 further includes the following steps.

910. Perform time-domain preprocessing on a primary sound channel signal in a current frame.

The preprocessing herein may include sampling rate conversion, pre-emphasis processing, and the like. For example, a primary sound channel signal with a sampling rate of 16 kHz may be converted into a signal with a sampling rate of 12.8 kHz such that ACELP of an encoding scheme is used for subsequent encoding processing.

920. Obtain an initial linear prediction analysis window in the current frame.

The initial linear prediction analysis window in step 920 is equivalent to the initial linear prediction analysis window in step 320.

930. Perform first-time windowing processing on the preprocessed primary sound channel signal based on the initial linear prediction analysis window, and calculate a first group of linear prediction coefficients in the current frame based on a signal obtained after windowing processing.

Performing first-time windowing processing on the preprocessed primary sound channel signal based on the initial linear prediction analysis window may be specifically performed according to Formula (26)

$$s_{wmid}(n)=(n-80)w(n), n=0,1, \ldots, L-1 \quad (26)$$

$s_{pre}(n)$ represents a signal obtained after pre-emphasis processing, $s_{wmid}(n)$ represents the signal obtained after first-time windowing processing, L represents a window length of a linear prediction analysis window, and w(n) represents the initial linear prediction analysis window.

The first group of linear prediction coefficients in the current frame may be specifically calculated according to a Levinson-Durbin algorithm. Specifically, the first group of linear prediction coefficients in the current frame may be calculated according to the Levinson-Durbin algorithm and based on the signal $s_{wmid}(n)$ obtained after first-time windowing processing.

940. Adaptively generate a modified linear prediction analysis window based on an inter-channel time difference in the current frame.

The modified linear prediction analysis window may be a linear prediction analysis window that meets the foregoing Formula (7) and Formula (9).

950. Perform second-time windowing processing on the preprocessed primary sound channel signal based on the modified linear prediction analysis window, and calculate a second group of linear prediction coefficients in the current frame based on a signal obtained after windowing processing.

Performing second-time windowing processing on the preprocessed primary sound channel signal based on the modified linear prediction analysis window may be specifically performed according to Formula (27).

$$s_{wend}(n)=s_{pre}(n+48)w_{adp}(n),n=0,1,\ldots,L-1 \quad (27)$$

$s_{pre}(n)$ represents a signal obtained after pre-emphasis processing, $s_{wend}(n)$ represents the signal obtained after second-time windowing processing, L represents a window length of the modified linear prediction analysis window, and $w_{adp}(n)$ represents the modified linear prediction analysis window.

The second group of linear prediction coefficients in the current frame may be specifically calculated according to the Levinson-Durbin algorithm. Specifically, the second group of linear prediction coefficients in the current frame may be calculated according to the Levinson-Durbin algorithm and based on the signal $s_{wend}(n)$ obtained after second-time windowing processing.

Similarly, a processing process of performing linear prediction analysis on a secondary sound channel signal in the current frame is the same as the process of performing linear prediction analysis on the primary sound channel signal in the current frame in step 910 to step 950.

It should be understood that the stereo signal encoding method in this application is the same as the second windowing processing manner in Manner 1.

Figure 10:
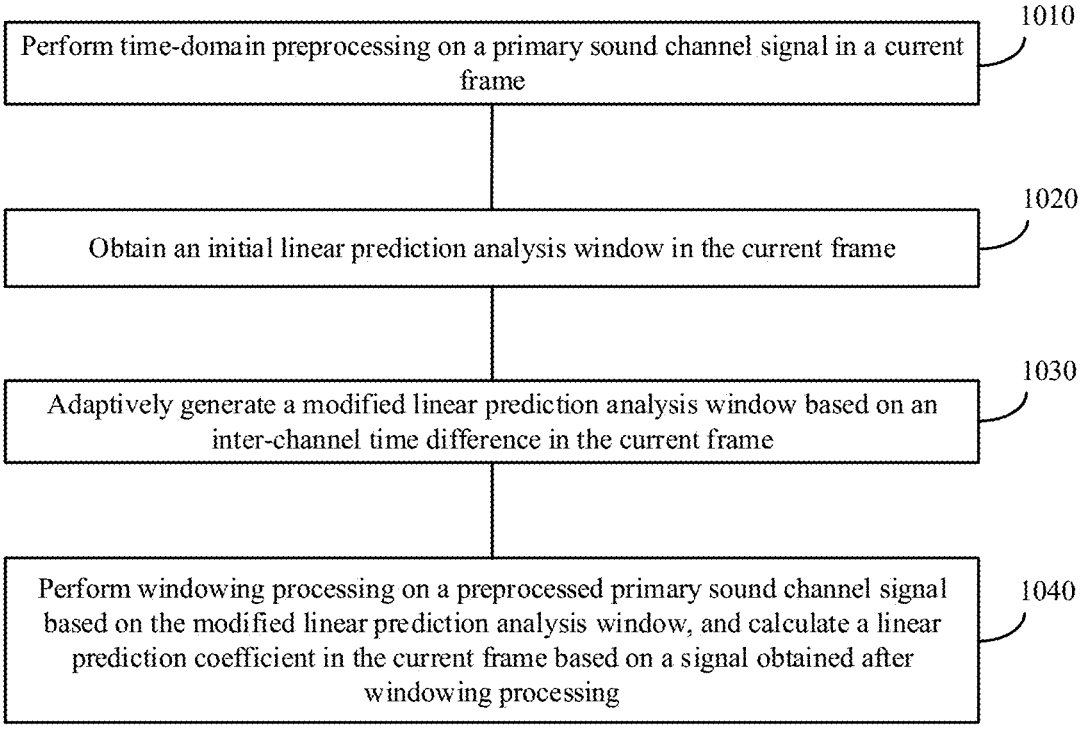
FIG. 10 is a schematic flowchart of a linear prediction analysis process according to an embodiment of this application.

FIG. 10 is a schematic flowchart of a linear prediction analysis process according to an embodiment of this application. The linear prediction process shown in FIG. 10 is to perform linear prediction analysis on a primary sound channel signal in a current frame once. The linear prediction analysis process shown in FIG. 10 further includes the following steps.

1010. Perform time-domain preprocessing on a primary sound channel signal in a current frame.

The preprocessing herein may include sampling rate conversion, pre-emphasis processing, and the like.

1020. Obtain an initial linear prediction analysis window in the current frame.

The initial linear prediction analysis window in step 1020 is equivalent to the initial linear prediction analysis window in step 320.

1030. Adaptively generate a modified linear prediction analysis window based on an inter-channel time difference in the current frame.

Specifically, a window length of an attenuation window in the current frame may be first determined based on the inter-channel time difference in the current frame, and then the modified linear prediction analysis window is determined in the manner in step 320.

1040. Perform windowing processing on the preprocessed primary sound channel signal based on the modified linear prediction analysis window, and calculate a linear prediction coefficient in the current frame based on a signal obtained after windowing processing.

Performing windowing processing on the preprocessed primary sound channel signal based on the modified linear prediction analysis window may be specifically performed according to Formula (28)

$$s_w(n)=s_{pre}(n)w_{adp}(n),n=0,1,\ldots,L-1 \quad (28)$$

$s_{pre}(n)$ represents a signal obtained after pre-emphasis processing, $s_w(n)$ represents the signal obtained after windowing processing, L represents a window length of the modified linear prediction analysis window, and $w_{adp}(n)$ represents the modified linear prediction analysis window.

It should be understood that the linear prediction coefficient in the current frame may be specifically calculated according to a Levinson-Durbin algorithm. Specifically, the linear prediction coefficient in the current frame may be calculated according to the Levinson-Durbin algorithm and based on the signal $s_w(n)$ obtained after windowing processing.

Similarly, a processing process of performing linear prediction analysis on a secondary sound channel signal in the current frame is the same as the process of performing linear prediction analysis on the primary sound channel signal in the current frame in step 1010 to step 1040.

The foregoing describes the stereo signal encoding method in the embodiments of this application in detail with FIG. 1 to FIG. 10. The following describes stereo signal encoding apparatuses in the embodiments of this application with reference to FIG. 11 and FIG. 12. It should be understood that the apparatuses in FIG. 11 and FIG. 12 correspond to the stereo signal encoding method in the embodiments of this application. In addition, the apparatuses in FIG. 11 and FIG. 12 may perform the stereo signal encoding method in the embodiments of this application. For brevity, repeated descriptions are appropriately omitted below.

Figure 11:
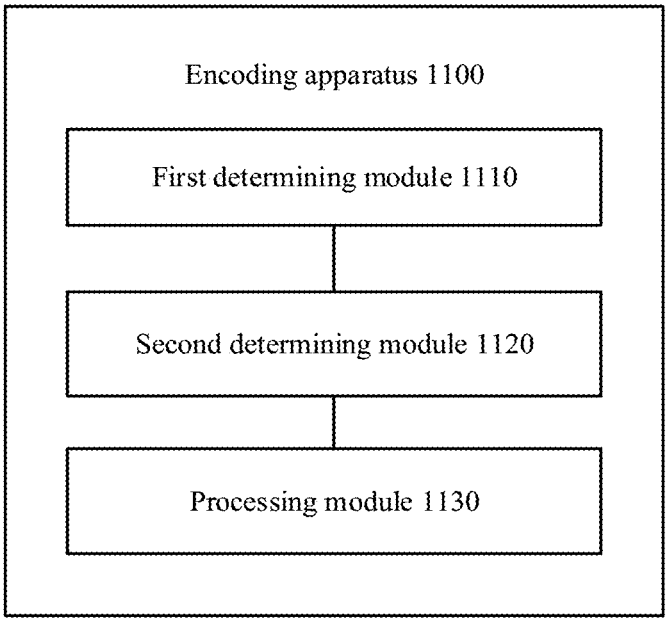
FIG. 11 is a schematic block diagram of an encoding apparatus according to an embodiment of this application.

FIG. 11 is a schematic block diagram of a stereo signal encoding apparatus according to an embodiment of this application. The apparatus 1100 in FIG. 11 includes a first determining module 1110 configured to determine a window length of an attenuation window in a current frame based on an inter-channel time difference in the current frame, a second determining module 1120 configured to determine a modified linear prediction analysis window based on the window length of the attenuation window in the current frame, where values of at least some points from a point (L−sub_window_len) to a point (L−1) in the modified linear prediction analysis window are less than values of corresponding points from a point (L−sub_window_len) to a point (L−1) in an initial linear prediction analysis window, sub_window_len represents the window length of the attenuation window in the current frame, L represents a window length of the modified linear prediction analysis window, and the window length of the modified linear prediction analysis window is equal to a window length of the initial linear prediction analysis window, and a processing module 1130 configured to perform linear prediction analysis on a to-be-processed sound channel signal based on the modified linear prediction analysis window.

In this application, because a value that is of a point in the modified linear prediction analysis window and that corresponds to a manually reconstructed forward signal on a target sound channel in the current frame is less than a value that is of a point in a to-be-modified linear prediction analysis window and that corresponds to the manually reconstructed forward signal on the target sound channel in the current frame, impact made by the manually reconstructed forward signal on the target sound channel in the current frame can be reduced during linear prediction such that impact of an error between the manually reconstructed forward signal and a real forward signal on accuracy of a linear prediction analysis result is reduced. Therefore, a difference between a linear prediction coefficient obtained through linear prediction analysis and a real linear prediction coefficient can be reduced, and accuracy of linear prediction analysis can be improved.

Optionally, in an embodiment, a value of any point from the point (L−sub_window_len) to the point (L−1) in the modified linear prediction analysis window is less than a value of a corresponding point from the point (L−sub_window_len) to the point (L−1) in the initial linear prediction analysis window.

Optionally, in an embodiment, the first determining module 1110 is further configured to determine the window length of the attenuation window in the current frame based on the inter-channel time difference in the current frame and a preset length of a transition segment.

Optionally, in an embodiment, the first determining module 1110 is further configured to determine a sum of an absolute value of the inter-channel time difference in the current frame and the preset length of the transition segment as the window length of the attenuation window in the current frame.

Optionally, in an embodiment, the first determining module 1110 is further configured to, when an absolute value of the inter-channel time difference in the current frame is greater than or equal to the preset length of the transition segment, determine a sum of the absolute value of the inter-channel time difference in the current frame and the preset length of the transition segment as the window length of the attenuation window in the current frame, or when an absolute value of the inter-channel time difference in the current frame is less than the preset length of the transition segment, determine N times of the absolute value of the inter-channel time difference in the current frame as the window length of the attenuation window in the current frame, where N is a preset real number greater than 0 and less than L/MAX_DELAY, and MAX_DELAY is a preset real number greater than 0.

Optionally, MAX_DELAY is a maximum value of the absolute value of the inter-channel time difference.

Optionally, in an embodiment, the second determining module 1120 is further configured to modify the initial linear prediction analysis window based on the window length of the attenuation window in the current frame, where attenuation values of values of the point (L−sub_window_len) to the point (L−1) in the modified linear prediction analysis window relative to values of corresponding points from the point (L−sub_window_len) to the point (L−1) in the initial linear prediction analysis window show a rising trend.

Optionally, in an embodiment, the modified linear prediction analysis window meets a formula $$w_{adp}(i) = \begin{cases} w(i), & i = 0, 1, \ldots, L - \text{sub_window_len} - 1 \\ w(i) - [i - (L - \text{sub_window_len})] * \text{delta}, & i = L - \text{sub_window_len}, \ldots, L - 1 \end{cases},$$

where $w_{adp}(i)$ represents the modified linear prediction analysis window, w(i) represents the initial linear prediction analysis window, $$\text{delta} = \frac{\text{MAX_ATTEN}}{\text{sub_window_len} - 1},$$

and MAX_ATTEN is a preset real number greater than 0.

Optionally, in an embodiment, the second determining module 1120 is further configured to determine the attenuation window in the current frame based on the window length of the attenuation window in the current frame, and modify the initial linear prediction analysis window based on the attenuation window in the current frame, where attenuation values of the values from the point (L−sub_window_len) to the point (L−1) in the modified linear prediction analysis window relative to the values of the corresponding points from the point (L−sub_window_len) to the point (L−1) in the initial linear prediction analysis window show a rising trend.

Optionally, in an embodiment, the second determining module 1120 is further configured to determine the attenuation window in the current frame from a plurality of prestored candidate attenuation windows based on the window length of the attenuation window in the current frame, where the plurality of candidate attenuation windows correspond to different window length value ranges, and there is no intersection set between the different window length value ranges.

Optionally, in an embodiment, the attenuation window in the current frame meets a formula $$\text{sub_window}(i) = i * \frac{\text{MAX_ATTEN}}{\text{sub_window_len} - 1},$$
$$i = 0, 1, \ldots, \text{sub_window_len} - 1,$$

where sub_window (i) represents the attenuation window in the current frame, and MAX_ATTEN is a preset real number greater than 0.

Optionally, in an embodiment, the modified linear prediction analysis window meets a formula $$w_{adp}(i) = \begin{cases} w(i), & i = 0, 1, \ldots, L - \text{sub_window_len} - 1 \\ w(i) - \text{sub_window}(i - (L - \text{sub_window_len})), & i = L - \text{sub_window_len}, \ldots, L - 1, \end{cases}$$

where $w_{adp}$) represents a window function of the modified linear prediction analysis window, w (i) represents the initial linear prediction analysis window, and sub_window(.) represents the attenuation window in the current frame.

Optionally, in an embodiment, the second determining module 1120 is further configured to determine the modified linear prediction analysis window from a plurality of prestored candidate linear prediction analysis windows based on the window length of the attenuation window in the current frame, where the plurality of candidate linear prediction analysis windows correspond to different window length value ranges, and there is no intersection set between the different window length value ranges.

Optionally, in an embodiment, before the second determining module 1120 determines the modified linear prediction analysis window based on the window length of the attenuation window in the current frame, the apparatus further includes a modification module 1140 configured to modify the window length of the attenuation window in the current frame based on a preset interval step, to obtain a modified window length of the attenuation window, where the interval step is a preset positive integer.

The second determining module 1120 is further configured to determine the modified linear prediction analysis window based on the initial linear prediction analysis window and the modified window length of the attenuation window.

Optionally, in an embodiment, the modified window length of the attenuation window meets a formula $$sub_window_len_mod = \lfloor sub_window_len / len_step \rfloor * len_step,$$

where sub_window_len_mod represents the modified window length of the attenuation window, and len_step represents the interval step.

Figure 12:
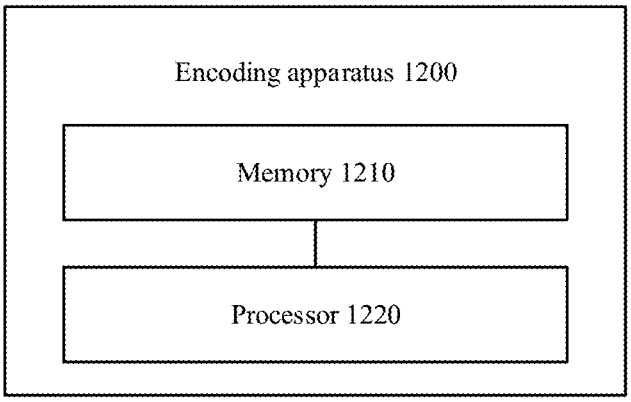
FIG. 12 is a schematic block diagram of an encoding apparatus according to an embodiment of this application.

FIG. 12 is a schematic block diagram of a stereo signal encoding apparatus according to an embodiment of this application. The apparatus 1200 in FIG. 12 includes a memory 1210 configured to store a program, and a processor 1220 configured to execute the program stored in the memory 1210, and when the program in the memory 1210 is executed, the processor 1220 is further configured to determine a window length of an attenuation window in a current frame based on an inter-channel time difference in the current frame, determine a modified linear prediction analysis window based on the window length of the attenuation window in the current frame, where values of at least some points from a point (L−sub_window_len) to a point (L−1) in the modified linear prediction analysis window are less than values of corresponding points from a point (L−sub_window_len) to a point (L−1) in an initial linear prediction analysis window, sub_window_len represents the window length of the attenuation window in the current frame, and L represents a window length of the modified linear prediction analysis window, and the window length of the modified linear prediction analysis window is equal to a window length of the initial linear prediction analysis window, and perform linear prediction analysis on a to-be-processed sound channel signal based on the modified linear prediction analysis window.

In this application, because a value that is of a point in the modified linear prediction analysis window and that corresponds to a manually reconstructed forward signal on a target sound channel in the current frame is less than a value that is of a point in a to-be-modified linear prediction analysis window and that corresponds to the manually reconstructed forward signal on the target sound channel in the current frame, impact made by the manually reconstructed forward signal on the target sound channel in the current frame can be reduced during linear prediction such that impact of an error between the manually reconstructed forward signal and a real forward signal on accuracy of a linear prediction analysis result is reduced. Therefore, a difference between a linear prediction coefficient obtained through linear prediction analysis and a real linear prediction coefficient can be reduced, and accuracy of linear prediction analysis can be improved.

Optionally, in an embodiment, a value of any point from the point (L−sub_window_len) to the point (L−1) in the modified linear prediction analysis window is less than a value of a corresponding point from the point (L−sub_window_len) to the point (L−1) in the initial linear prediction analysis window.

Optionally, in an embodiment, the processor 1220 is further configured to determine the window length of the attenuation window in the current frame based on the inter-channel time difference in the current frame and a preset length of a transition segment.

Optionally, in an embodiment, the processor 1220 is further configured to determine a sum of an absolute value of the inter-channel time difference in the current frame and the preset length of the transition segment as the window length of the attenuation window in the current frame.

Optionally, in an embodiment, the processor 1220 is further configured to, when an absolute value of the inter-channel time difference in the current frame is greater than or equal to the preset length of the transition segment, determine a sum of the absolute value of the inter-channel time difference in the current frame and the preset length of the transition segment as the window length of the attenuation window in the current frame, or when an absolute value of the inter-channel time difference in the current frame is less than the preset length of the transition segment, determine N times of the absolute value of the inter-channel time difference in the current frame as the window length of the attenuation window in the current frame, where N is a preset real number greater than 0 and less than L/MAX_DELAY, and MAX_DELAY is a preset real number greater than 0.

Optionally, MAX_DELAY is a maximum value of the absolute value of the inter-channel time difference.

Optionally, in an embodiment, the processor 1220 is further configured to modify the initial linear prediction analysis window based on the window length of the attenuation window in the current frame, where attenuation values of values of the point (L−sub_window_len) to the point (L−1) in the modified linear prediction analysis window relative to values of corresponding points from the point (L−sub_window_len) to the point (L−1) in the initial linear prediction analysis window show a rising trend.

Optionally, in an embodiment, the modified linear prediction analysis window meets a formula $$w_{adp}(i) = \begin{cases} w(i), \ i = 0, 1, \ldots, \\ L - \text{sub_window_len} - 1 \\ w(i) - [i - (L - \text{sub_window_len})] * \text{delta}, \\ i = L - \text{sub_window_len}, \ldots, L - 1, \end{cases}$$

where $w_{adp}(i)$ represents the modified linear prediction analysis window, w(i) represents the initial linear prediction analysis window, $$\text{delta} = \frac{\text{MAX_ATTEN}}{\text{sub_window_len} - 1},$$

and MAX_ATTEN is a preset real number greater than 0.

Optionally, in an embodiment, the processor 1220 is further configured to determine the attenuation window in the current frame based on the window length of the attenuation window in the current frame, and modify the initial linear prediction analysis window based on the attenuation window in the current frame, where attenuation values of the values from the point (L−sub_window_len) to the point (L−1) in the modified linear prediction analysis window relative to the values of the corresponding points from the point (L−sub_window_len) to the point (L−1) in the initial linear prediction analysis window show a rising trend.

Optionally, in an embodiment, the processor 1220 is further configured to determine the attenuation window in the current frame from a plurality of prestored candidate attenuation windows based on the window length of the attenuation window in the current frame, where the plurality of candidate attenuation windows correspond to different window length value ranges, and there is no intersection set between the different window length value ranges.

Optionally, in an embodiment, the attenuation window in the current frame meets a formula $$\text{sub_window}(i) = i^* \frac{\text{MAX_ATTEN}}{\text{sub_window_len} - 1},$$
$$i = 0, 1, \ldots, \text{sub_window_len} - 1,$$

where sub_window (i) represents the attenuation window in the current frame, and MAX_ATTEN is a preset real number greater than 0.

Optionally, in an embodiment, the modified linear prediction analysis window meets a formula $$w_{adp}(i) = \begin{cases} w(i),\ i = 0, 1, \ldots, \\ L - \text{sub_window_len} - 1 \\ w(i) - \text{sub_window}(i - (L - \text{sub_window_len})), \\ \quad i = L - \text{sub_window_len}, \ldots, L - 1, \end{cases}$$

where $w_{adp}(i)$ represents a window function of the modified linear prediction analysis window, w(i) represents the initial linear prediction analysis window, and sub_window(.) represents the attenuation window in the current frame.

Optionally, in an embodiment, the processor 1220 is further configured to determine the modified linear prediction analysis window from a plurality of prestored candidate linear prediction analysis windows based on the window length of the attenuation window in the current frame, where the plurality of candidate linear prediction analysis windows correspond to different window length value ranges, and there is no intersection set between the different window length value ranges.

Optionally, in an embodiment, before the processor 1220 determines the modified linear prediction analysis window based on the window length of the attenuation window in the current frame, the processor 1220 is further configured to modify the window length of the attenuation window in the current frame based on a preset interval step, to obtain a modified window length of the attenuation window, where the interval step is a preset positive integer, and determine the modified linear prediction analysis window based on the initial linear prediction analysis window and the modified window length of the attenuation window.

Optionally, in an embodiment, the modified window length of the attenuation window meets a formula $$\text{sub_window_len_mod} = \lfloor \text{sub_window_len} / \text{len_step} \rfloor * \text{len_step},$$

where sub_window_len_mod represents the modified window length of the attenuation window, and len_step represents the interval step.

The foregoing describes the stereo signal encoding apparatuses in the embodiments of this application with reference to FIG. 11 and FIG. 12. The following describes a terminal device and a network device in the embodiments of this application with reference to FIG. 13 to FIG. 18. It should be understood that, the stereo signal encoding method in the embodiments of this application may be performed by the terminal device or the network device in FIG. 13 to FIG. 18. In addition, the encoding apparatus in the embodiments of this application may be disposed in the terminal device or the network device in FIG. 13 to FIG. 18. Specifically, the encoding apparatus in the embodiments of this application may be a stereo encoder in the terminal device or the network device in FIG. 13 to FIG. 18.

Figure 13:
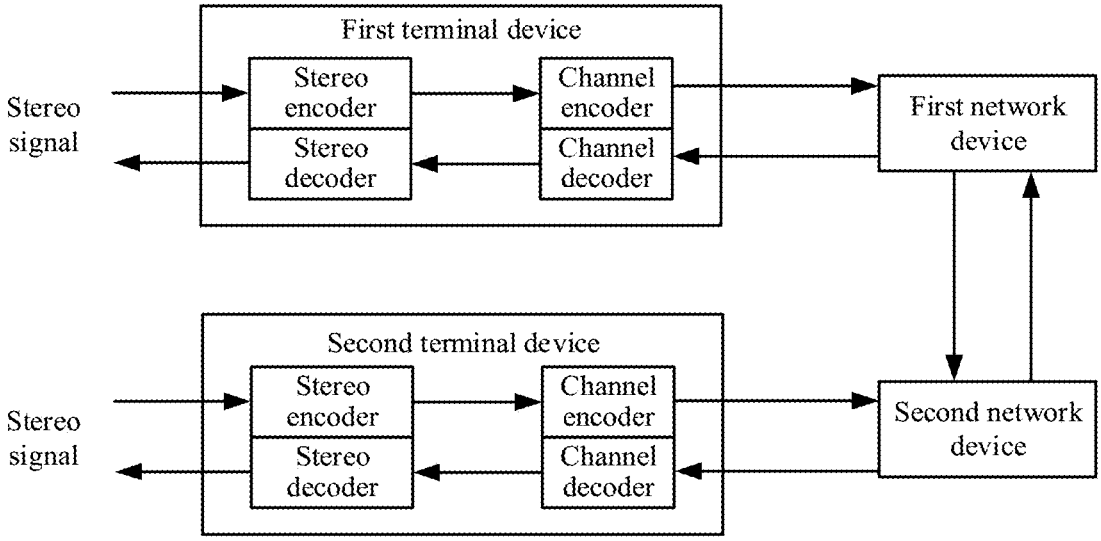
FIG. 13 is a schematic diagram of a terminal device according to an embodiment of this application.

As shown in FIG. 13, in audio communication, a stereo encoder in a first terminal device performs stereo encoding on a collected stereo signal, and a channel encoder in the first terminal device may perform channel encoding on a bitstream obtained by the stereo encoder. Next, the first terminal device transmits, using a first network device and a second network device, data obtained after channel encoding to the second terminal device. After the second terminal device receives the data from the second network device, a channel decoder of the second terminal device performs channel decoding to obtain an encoded bitstream of the stereo signal. A stereo decoder of the second terminal device restores the stereo signal through decoding, and the second terminal device plays back the stereo signal. In this way, audio communication is completed between different terminal devices.

It should be understood that, in FIG. 13, the second terminal device may also encode the collected stereo signal, and finally transmit, using the second network device and the first network device, data obtained after encoding to the first terminal device. The first terminal device performs channel decoding and stereo decoding on the data to obtain the stereo signal.

In FIG. 13, the first network device and the second network device may be wireless network communications devices or wired network communications devices. The first network device and the second network device may communicate with each other on a digital channel.

The first terminal device or the second terminal device in FIG. 13 may perform the stereo signal encoding/decoding method in the embodiments of this application. The encoding apparatus and the decoding apparatus in the embodiments of this application may be respectively a stereo encoder and a stereo decoder in the first terminal device, or may be respectively a stereo encoder and a stereo decoder in the second terminal device.

Figure 14:
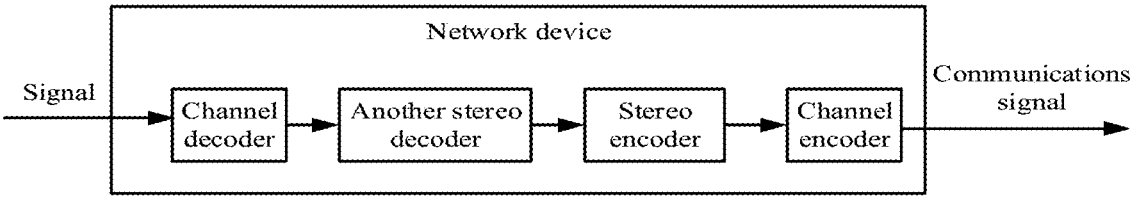
FIG. 14 is a schematic diagram of a network device according to an embodiment of this application.

In audio communication, a network device can implement transcoding of a codec format of an audio signal. As shown in FIG. 14, if a codec format of a signal received by a network device is a codec format corresponding to another stereo decoder, a channel decoder in the network device performs channel decoding on the received signal to obtain an encoded bitstream corresponding to the other stereo decoder. The other stereo decoder decodes the encoded bitstream to obtain a stereo signal. A stereo encoder encodes the stereo signal to obtain an encoded bitstream of the stereo signal. Finally, a channel encoder performs channel encoding on the encoded bitstream of the stereo signal to obtain a final signal (where the signal may be transmitted to a terminal device or another network device). It should be understood that a codec format corresponding to the stereo encoder in FIG. 14 is different from the codec format corresponding to the other stereo decoder. Assuming that the codec format corresponding to the other stereo decoder is a first codec format, and that the codec format corresponding to the stereo encoder is a second codec format, in FIG. 14, converting an audio signal from the first codec format to the second codec format is implemented by the network device.

Figure 15:
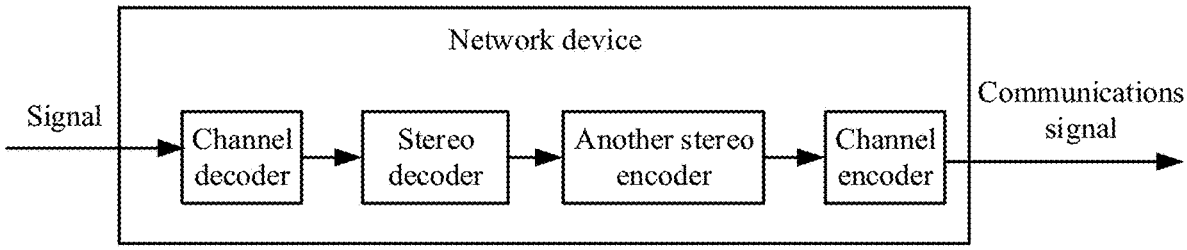
FIG. 15 is a schematic diagram of a network device according to an embodiment of this application.

Similarly, as shown in FIG. 15, if a codec format of a signal received by a network device is the same as a codec format corresponding to a stereo decoder, after a channel decoder of the network device performs channel decoding to obtain an encoded bitstream of a stereo signal, the stereo decoder may decode the encoded bitstream of the stereo signal to obtain the stereo signal. Next, another stereo encoder encodes the stereo signal based on another codec format, to obtain an encoded bitstream corresponding to the other stereo encoder. Finally, a channel encoder performs channel encoding on the encoded bitstream corresponding to the other stereo encoder to obtain a final signal (where the signal may be transmitted to a terminal device or another network device). Similar to the case in FIG. 14, the codec format corresponding to the stereo decoder in FIG. 15 is also different from a codec format corresponding to the other stereo encoder. If the codec format corresponding to the other stereo encoder is a first codec format, and the codec format corresponding to the stereo decoder is a second codec format, in FIG. 15, converting an audio signal from the second codec format to the first codec format is implemented by the network device.

The other stereo decoder and the stereo encoder in FIG. 14 correspond to different codec formats, and the stereo decoder and the other stereo encoder in FIG. 15 correspond to different codec formats. Therefore, transcoding of a codec format of a stereo signal is implemented through processing performed by the other stereo decoder and the stereo encoder or performed by the stereo decoder and the other stereo encoder.

It should be further understood that the stereo encoder in FIG. 14 can implement the stereo signal encoding method in the embodiments of this application, and the stereo decoder in FIG. 15 can implement the stereo signal decoding method in the embodiments of this application. The encoding apparatus in the embodiments of this application may be the stereo encoder in the network device in FIG. 14. The decoding apparatus in the embodiments of this application may be the stereo decoder in the network device in FIG. 15. In addition, the network devices in FIG. 14 and FIG. 15 may be specifically wireless network communications devices or wired network communications devices.

Figure 16:
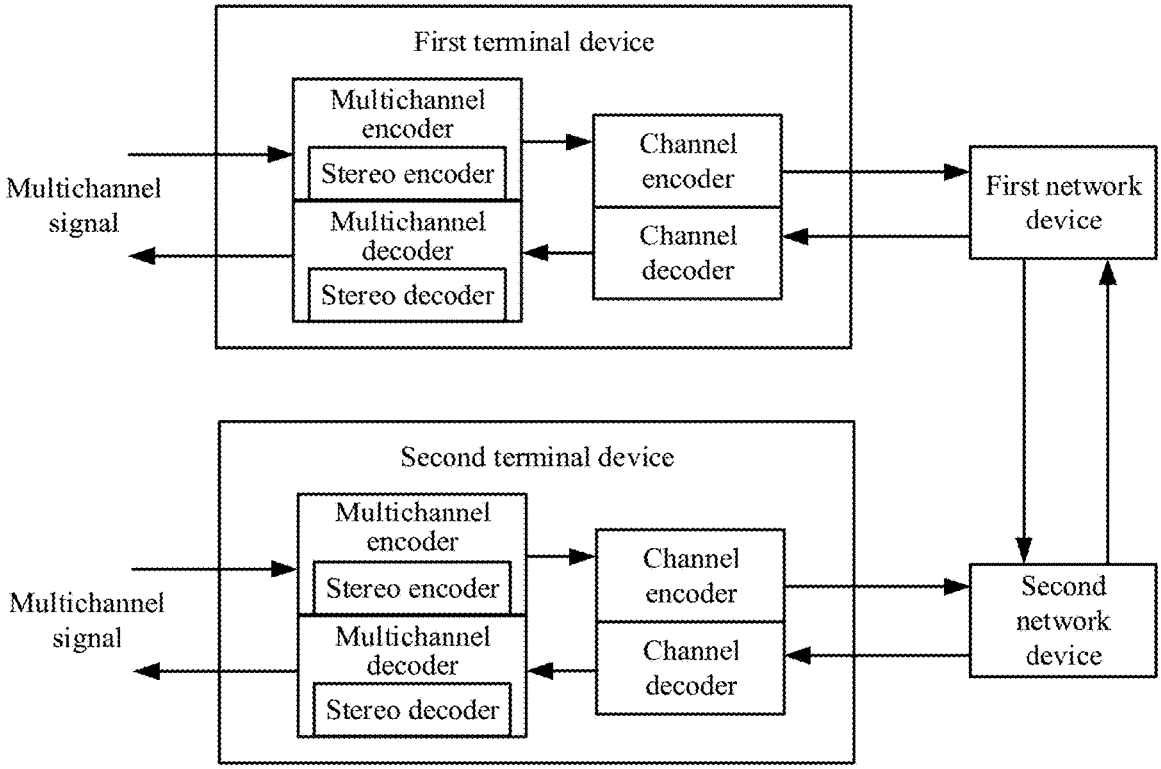
FIG. 16 is a schematic diagram of a terminal device according to an embodiment of this application.

As shown in FIG. 16, in audio communication, a stereo encoder in a multichannel encoder in a first terminal device performs stereo encoding on a stereo signal generated from a collected multichannel signal, where a bitstream obtained by the multichannel encoder includes a bitstream obtained by the stereo encoder. A channel encoder in the first terminal device may perform channel encoding on the bitstream obtained by the multichannel encoder. Next, the first terminal device transmits, using a first network device and a second network device, data obtained after channel encoding to a second terminal device. After the second terminal device receives the data from the second network device, a channel decoder of the second terminal device performs channel decoding to obtain an encoded bitstream of the multichannel signal, where the encoded bitstream of the multichannel signal includes an encoded bitstream of a stereo signal. A stereo decoder in a multichannel decoder of the second terminal device restores the stereo signal through decoding. The multichannel decoder obtains the multichannel signal through decoding based on the restored stereo signal, and the second terminal device plays back the multichannel signal. In this way, audio communication is completed between different terminal devices.

It should be understood that, in FIG. 16, the second terminal device may also encode the collected multichannel signal (specifically, a stereo encoder in a multichannel encoder in the second terminal device performs stereo encoding on a stereo signal generated from the collected multichannel signal. Then, a channel encoder in the second terminal device performs channel encoding on a bitstream obtained by the multichannel encoder), and finally transmits the encoded bitstream to the first terminal device using the second network device and the first network device. The first terminal device obtains the multichannel signal through channel decoding and multichannel decoding.

In FIG. 16, the first network device and the second network device may be wireless network communications devices or wired network communications devices. The first network device and the second network device may communicate with each other on a digital channel.

The first terminal device or the second terminal device in FIG. 16 may perform the stereo signal encoding/decoding method in the embodiments of this application. In addition, the encoding apparatus in the embodiments of this application may be the stereo encoder in the first terminal device or the second terminal device, and the decoding apparatus in the embodiments of this application may be the stereo decoder in the first terminal device or the second terminal device.

Figure 17:
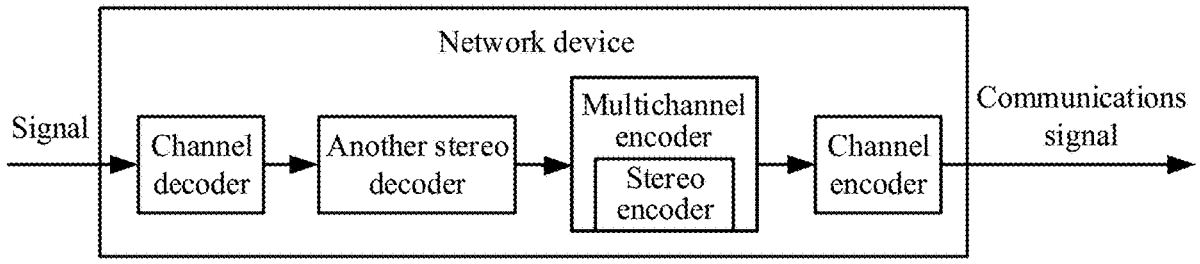
FIG. 17 is a schematic diagram of a network device according to an embodiment of this application.

In audio communication, a network device can implement transcoding of a codec format of an audio signal. As shown in FIG. 17, if a codec format of a signal received by a network device is a codec format corresponding to another multichannel decoder, a channel decoder in the network device performs channel decoding on the received signal to obtain an encoded bitstream corresponding to the other multichannel decoder. The other multichannel decoder decodes the encoded bitstream to obtain a multichannel signal. A multichannel encoder encodes the multichannel signal to obtain an encoded bitstream of the multichannel signal. A stereo encoder in the multichannel encoder performs stereo encoding on a stereo signal generated from the multichannel signal to obtain an encoded bitstream of the stereo signal, where the encoded bitstream of the multichannel signal includes the encoded bitstream of the stereo signal. Finally, a channel encoder performs channel encoding on the encoded bitstream to obtain a final signal (where the signal may be transmitted to a terminal device or another network device).

Figure 18:
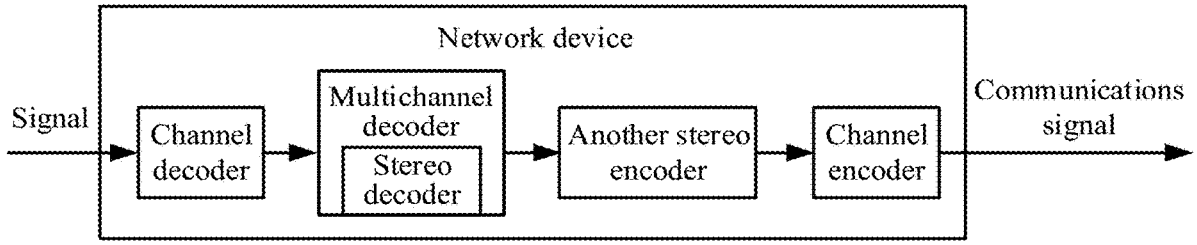
FIG. 18 is a schematic diagram of a network device according to an embodiment of this application.

Similarly, as shown in FIG. 18, if a codec format of a signal received by a network device is the same as a codec format corresponding to a multichannel decoder, after a channel decoder of the network device performs channel decoding to obtain an encoded bitstream of a multichannel signal, the multichannel decoder may decode the encoded bitstream of the multichannel signal to obtain the multichannel signal. A stereo decoder in the multichannel decoder performs stereo decoding on an encoded bitstream of a stereo signal in the encoded bitstream of the multichannel signal. Next, another multichannel encoder encodes the multichannel signal based on another codec format, to obtain an encoded bitstream of a multichannel signal corresponding to another multichannel encoder. Finally, a channel encoder performs channel encoding on the encoded bitstream corresponding to the other multichannel encoder, to obtain a final signal (where the signal may be transmitted to a terminal device or another network device).

It should be understood that, the other stereo decoder and the multichannel encoder in FIG. 17 correspond to different codec formats, and the multichannel decoder and the other stereo encoder in FIG. 18 correspond to different codec formats. For example, in FIG. 17, if the codec format corresponding to the other stereo decoder is a first codec format, and the codec format corresponding to the multichannel encoder is a second codec format, converting an audio signal from the first codec format to the second codec format is implemented by the network device. Similarly, in FIG. 18, assuming that the codec format corresponding to the multichannel decoder is a second codec format, and the codec format corresponding to the other stereo encoder is a first codec format, converting an audio signal from the second codec format to the first codec format is implemented by the network device. Therefore, transcoding of a codec format of an audio signal is implemented through processing performed by the other stereo decoder and the multichannel encoder or performed by the multichannel decoder and the other stereo encoder.

It should be further understood that the stereo encoder in FIG. 17 can implement the stereo signal encoding method in the embodiments of this application, and the stereo decoder in FIG. 18 can implement the stereo signal decoding method in the embodiments of this application. The encoding apparatus in the embodiments of this application may be the stereo encoder in the network device in FIG. 17. The decoding apparatus in the embodiments of this application may be the stereo decoder in the network device in FIG. 18. In addition, the network devices in FIG. 17 and FIG. 18 may be specifically wireless network communications devices or wired network communications devices.

This application further provides a chip. The chip includes a processor and a communications interface. The communications interface is configured to communicate with an external component, and the processor is configured to perform the stereo signal encoding method in the embodiments of this application.

Optionally, in an implementation, the chip may further include a memory. The memory stores an instruction, and the processor is configured to execute the instruction stored in the memory. When the instruction is executed, the processor is configured to perform the stereo signal encoding method in the embodiments of this application.

Optionally, in an implementation, the chip is integrated into a terminal device or a network device.

This application provides a computer readable storage medium. The computer readable storage medium is configured to store program code executed by a device, and the program code includes an instruction used to perform the stereo signal encoding method in the embodiments of this application.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of this application.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in this application, it should be understood that the disclosed systems, apparatuses, and methods may be implemented in other manners. For example, the described apparatus embodiments are merely examples. For example, the unit division is merely logical function division and may be other division in an embodiment. For example, a plurality of units or components may be combined or integrated into another system, or some features may be ignored or not performed. In addition, the displayed or discussed mutual couplings or direct couplings or communication connections may be implemented using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected based on actual requirements to achieve the objectives of the solutions of the embodiments.

In addition, functional units in the embodiments of this application may be integrated into one processing unit, or each of the units may exist alone physically, or two or more units are integrated into one unit.

When the functions are implemented in the form of a software functional unit and sold or used as an independent product, the functions may be stored in a computer readable storage medium. Based on such an understanding, the technical solutions of this application essentially, or the part contributing to other approaches, or some of the technical solutions may be implemented in a form of a software product. The computer software product is stored in a storage medium, and includes several instructions for instructing a computer device (which may be a personal computer, a server, a network device, or the like) to perform all or some of the steps of the methods described in the embodiments of this application. The foregoing storage medium includes any medium that can store program code, such as a universal serial bus (USB) flash drive, a removable hard disk, a read-only memory (read-only memory, ROM), a random access memory (RAM), a magnetic disk, or an optical disc.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A stereo signal encoding method, comprising:

obtaining an inter-channel time difference (ITD) of a current frame of a stereo signal;

obtaining a first window length of an attenuation window of the current frame based on the ITD;

obtaining a modified linear prediction analysis window based on the first window length, wherein values of at least some points from a first point (L−sub_window_len) in the modified linear prediction analysis window to a second point (L−1) in the modified linear prediction analysis window are less than values of corresponding points from a third point (L−sub_window_len) in an initial linear prediction analysis window to a fourth point (L−1) in the initial linear prediction analysis window, wherein sub_window_len represents the first window length, wherein L represents a second window length of the modified linear prediction analysis window, and wherein the second window length corresponds to a third window length of the initial linear prediction analysis window; and performing linear prediction analysis on a channel signal of the stereo signal based on the modified linear prediction analysis window.

2. The stereo signal encoding method of claim 1, further comprising further obtaining the first window length based on a preset length of a transition segment.

3. The stereo signal encoding method of claim 2, further comprising:

setting a sum of an absolute value of the ITD and the preset length as the first window length;

setting the sum as the first window length when the absolute value of the ITD is greater than or equal to the preset length; or setting N times of the absolute value of the ITD as the first window length when the absolute value of the ITD is less than the preset length, wherein N is a first preset real number greater than 0 and less than L/MAX_DELAY, and wherein MAX_DELAY is a second preset real number greater than 0.

4. The stereo signal encoding method of claim 1, wherein obtaining the modified linear prediction analysis window comprises modifying the initial linear prediction analysis window based on the first window length, wherein attenuation values of values of the first point to the second point relative to values of corresponding points from the third point to the fourth point show a rising trend.

5. The stereo signal encoding method of claim 4, wherein the modified linear prediction analysis window satisfies the following equation:

$$w_{adp}(i) = \begin{cases} w(i),\ i = 0, 1, \ldots, L - \text{sub_window_len} - 1 \\ w(i) - [i - (L - \text{sub_window_len})] * \text{delta}, \\ i = L - \text{sub_window_len}, \ldots, L - 1, \end{cases}$$

wherein $w_{adp}$ (i) represents the modified linear prediction analysis window, wherein w (i) represents the initial linear prediction analysis window, wherein $$\text{delta} = \frac{\text{MAX_ATTEN}}{\text{sub_window_len} - 1},$$

and wherein MAX_ATTEN is a preset real number greater than 0.

6. The stereo signal encoding method of claim 1, further comprising:

obtaining the attenuation window based on the first window length; and modifying the initial linear prediction analysis window based on the attenuation window, wherein attenuation values of values of the first point to the second point relative to values of corresponding points from the third point to the fourth point show a rising trend.

7. The stereo signal encoding method of claim 6, wherein the attenuation window satisfies the following equation:

$$\text{sub_window}(i) = i^* \frac{\text{MAX_ATTEN}}{\text{sub_window_len} - 1},$$

$$i = 0, 1, \ldots, \text{sub_window_len} - 1,$$

wherein sub_window( )represents the attenuation window, and wherein MAX_ATTEN is a preset real number greater than 0.

8. The stereo signal encoding method of claim 7, wherein the modified linear prediction analysis window satisfies the following equation:

$$w_{adp}(i) = \begin{cases} w(i),\ i = 0, 1, \ldots, L - \text{sub_window_len} - 1 \\ w(i) - \text{sub_window}(i - (L - \text{sub_window_len})), \\ i = L - \text{sub_window_len}, \ldots, L - 1 \end{cases},$$

wherein $w_{adp}$(i) represents a window function of the modified linear prediction analysis window, and wherein W(i) represents the initial linear prediction analysis window.

9. The stereo signal encoding method of claim 1, further comprising obtaining the modified linear prediction analysis window from a plurality of prestored candidate linear prediction analysis windows based on the first window length, wherein the plurality of prestored candidate linear prediction analysis windows correspond to different window length value ranges, and wherein there is no intersection set between the different window length value ranges.

10. The stereo signal encoding method of claim 1, further comprising:

modifying the first window length based on a preset interval step to obtain a modified first window length, wherein the preset interval step is a preset positive integer; and obtaining the modified linear prediction analysis window based on the initial linear prediction analysis window and the modified first window length.

11. The stereo signal encoding method of claim 10, wherein the modified first window length satisfies the following equation:

$$\textit{sub_window_len_mod} = \lfloor \textit{sub_window_len} / \textit{len_step} \rfloor * \textit{len_step}$$

wherein sub_window_len_mod represents the modified first window length, and wherein len_step represents the preset interval step.

12. An encoding apparatus, comprising:

at least one processor; and one or more memories coupled to the at least one processor and configured to store programming instructions for execution by the at least one processor to cause the encoding apparatus to:

obtain an inter-channel time difference (ITD) of a current frame of a stereo signal;

obtain a first window length of an attenuation window of the current frame based on the ITD;

obtain a modified linear prediction analysis window based on the first window length, wherein values of at least some points from a first point (L–sub_window_len) in the modified linear prediction analysis window to a second point (L–1) in the modified linear prediction analysis window are less than values of corresponding points from a third point (L–sub_window_len) in an initial linear prediction analysis window to a fourth point (L–1) in the initial linear prediction analysis window, wherein sub_window_len represents the first window length, wherein L represents a second window length of the modified linear prediction analysis window, and wherein the second window length corresponds to a third window length of the initial linear prediction analysis window; and perform linear prediction analysis on a channel signal of the stereo signal based on the modified linear prediction analysis window.

13. The encoding apparatus of claim 12, wherein the programming instructions further cause the encoding apparatus to obtain the first window length based on the ITD and a preset length of a transition segment.

14. The encoding apparatus of claim 13, wherein the programming instructions further cause the encoding apparatus to:

set a sum of an absolute value of the ITD and the preset length as the first window length;

set the sum as the first window length when the absolute value of the ITD is greater than or equal to the preset length; or set N times of the absolute value of the ITD as the first window length when the absolute value of the ITD is less than the preset length, wherein N is a first preset real number greater than 0 and less than L/MAX_DELAY, and wherein MAX_DELAY is a second preset real number greater than 0.

15. The encoding apparatus of claim 12, wherein the programming instructions further cause the encoding apparatus to modify the initial linear prediction analysis window based on the first window length, wherein attenuation values of values of the first point to the second point relative to values of corresponding points from the third point to the fourth point show a rising trend.

16. The encoding apparatus of claim 15, wherein the modified linear prediction analysis window satisfies the following equation:

$$w_{adp}(i) = \begin{cases} w(i),\ i = 0, 1, \ldots, \\ L - \text{sub_window_len} - 1 \\ w(i) - [i - (L - \text{sub_window_len})] * \text{delta}, \\ i = L - \text{sub_window_len}, \ldots, L - 1, \end{cases}$$

wherein $w_{adp}$ represents the modified linear prediction analysis window, wherein w (i) represents the initial linear prediction analysis window, $$\text{delta} = \frac{\text{MAX_ATTEN}}{\text{sub_window_len} - 1},$$

and wherein MAX_ATTEN is a preset real number greater than 0.

17. The encoding apparatus of claim 12, wherein the programming instructions further cause the encoding apparatus to:

obtain the attenuation window based on the first window length; and modify the initial linear prediction analysis window based on the attenuation window, wherein attenuation values of values of the first point to the second point relative to values of corresponding points from the third point to the fourth point show a rising trend.

18. The encoding apparatus of claim 17, wherein the attenuation window satisfies the following equation:

$$\text{sub_window}(i) = i * \frac{\text{MAX_ATTEN}}{\text{sub_window_len} - 1},$$

$$i = 0, 1, \ldots, \text{sub_window_len} - 1,$$

wherein sub_window (i) represents the attenuation window, and wherein MAX_ATTEN is a preset real number greater than 0.

19. The encoding apparatus of claim 18, wherein the modified linear prediction analysis window satisfies the following equation:

$$w_{adp}(i) = \begin{cases} w(i),\ i = 0, 1, \ldots, \\ L - \text{sub_window_len} - 1 \\ w(i) - \text{sub_window}(i - (L - \text{sub_window_len})), \\ i = L - \text{sub_window_len}, \ldots, L - 1, \end{cases}$$

wherein $w_{adp}(i)$ represents a window function of the modified linear prediction analysis window, and wherein W(i) represents the initial linear prediction analysis window.

20. The encoding apparatus of claim 12, wherein the programming instructions further cause the encoding apparatus to obtain the modified linear prediction analysis window from a plurality of prestored candidate linear prediction analysis windows based on the first window length, wherein the plurality of prestored candidate linear prediction analysis windows correspond to different window length value ranges, and wherein there is no intersection set between the different window length value ranges.

21. The encoding apparatus of claim 20, wherein the programming instructions further cause the encoding apparatus to:

modify the first window length based on a preset interval step to obtain a modified first window length, wherein the preset interval step is a preset positive integer; and obtain the modified linear prediction analysis window based on the initial linear prediction analysis window and the modified first window length.

22. The encoding apparatus of claim 21, wherein the modified first window length satisfies the following equation:

$$sub_window_len_mod = \lfloor sub_window_len / len_step \rfloor * len_step$$

wherein sub_window_len_mod represents the modified first window length, and wherein len_step represents the preset interval step.

* * * * *